US009664156B2

(12) United States Patent
Tanaka

(10) Patent No.: US 9,664,156 B2
(45) Date of Patent: May 30, 2017

(54) ENGINE UNIT OF MOTORCYCLE

(71) Applicant: SUZUKI MOTOR CORPORATION, Hamamatsu-shi, Shizuoka (JP)

(72) Inventor: Koichi Tanaka, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 13 days.

(21) Appl. No.: 14/965,000

(22) Filed: Dec. 10, 2015

(65) Prior Publication Data

US 2016/0097356 A1 Apr. 7, 2016

Related U.S. Application Data

(62) Division of application No. 14/047,166, filed on Oct. 7, 2013, now Pat. No. 9,249,725.

(30) Foreign Application Priority Data

Nov. 8, 2012 (JP) ..... 2012-246533
Dec. 25, 2012 (JP) ..... 2012-281712

(51) Int. Cl.

| | |
|---|---|
| ***F02M 35/10*** | (2006.01) |
| ***F02M 35/16*** | (2006.01) |
| ***F02B 75/20*** | (2006.01) |
| ***F02B 61/02*** | (2006.01) |
| *F02D 9/10* | (2006.01) |

(52) U.S. Cl.

CPC ..... *F02M 35/162* (2013.01); *F02B 61/02* (2013.01); *F02B 75/20* (2013.01); *F02M 35/10006* (2013.01); *F02M 35/10019* (2013.01); *F02M 35/10111* (2013.01); *F02M 35/10216* (2013.01); *F02D 9/105* (2013.01); *F02M 2700/4309* (2013.01)

(58) Field of Classification Search

CPC ..... F02M 35/162; F02M 35/112; F02M 35/10216; F02M 35/10019; F02M 35/10111; F02M 35/10006; F02M 61/14; F02M 61/145; F02M 61/02; F02M 2700/4309; F02B 61/02; F02B 75/20; F02D 9/105; F02D 9/107

USPC ..... 123/337, 399, 470, 184.38

See application file for complete search history.

(56) References Cited

U.S. PATENT DOCUMENTS

2013/0062135 A1 3/2013 Saitoh et al.

FOREIGN PATENT DOCUMENTS

| | | | |
|---|---|---|---|
| JP | 57-046027 | A | 3/1982 |
| JP | 2002-256895 | A | 9/2002 |
| JP | 2002-256896 | A | 9/2002 |
| JP | 2007-230301 | A | 9/2007 |

(Continued)

OTHER PUBLICATIONS

European Search Report dated Feb. 11, 2015 issued in corresponding European Applicaiton No. 13182569.7.

(Continued)

*Primary Examiner* — Hai Huynh
(74) *Attorney, Agent, or Firm* — Troutman Sanders LLP

(57) ABSTRACT

A plurality of cylinders are disposed in parallel in a vehicle width direction, a clutch chamber is disposed in either one of the right and the left in the vehicle width direction, an intake manifold, a fuel injection device, a throttle body, and an intake pipe are disposed between a cylinder assembly and an air cleaner in an upper part of a crankcase assembly. The throttle body is disposed on an opposite side in the vehicle width direction of the clutch chamber.

8 Claims, 23 Drawing Sheets

(56) References Cited

FOREIGN PATENT DOCUMENTS

| | | | |
|---|---|---|---|
| JP | 2010-196633 | A | 9/2010 |
| JP | 2010-281223 | A | 12/2010 |
| WO | 2011/132432 | A1 | 10/2011 |

OTHER PUBLICATIONS

Notice of Allowance mailed on Sep. 25, 2015, issued in related U.S. Appl. No. 14/047,166.
Restriction Requirement mailed on Aug. 21, 2015, issued in related U.S. Appl. No. 14/047,166.
Japanese Office Action mailed Aug. 23, 2016 of the corresponding Japanese Patent Application No. 2012-246533.

ENGINE UNIT OF MOTORCYCLE

CROSS-REFERENCE TO RELATED APPLICATIONS

This application is a divisional application of U.S. application Ser. No. 14/047,166, filed Oct. 7 2013, which claims the benefit of priority of the prior Japanese Patent Application No. 2012-246533, filed on Nov. 8, 2012, and the Japanese Patent Application No. 2012-281712, filed on Dec. 25, 2012, the entire contents of each of which are incorporated herein by reference.

BACKGROUND OF THE INVENTION

Field of the Invention

The present invention relates to an engine unit of a vehicle such as an automobile, and specifically to a neighborhood of an intake system thereof.

Description of the Related Art

An intake system of an engine unit of a typical motorcycle has an intake tube connected to an intake port of an engine (internal combustion engine), and a throttle valve adjusting an opening degree of the intake tube. In a motorcycle on which a parallel multi-cylinder engine is mounted, a space in which a throttle body or an intake tube is disposed is generally smaller compared with that of a four-wheel vehicle. Thus, in Patent Documents 1, 2, constitutions in each of which a drive motor driving a throttle valve is disposed on a same side as that of a fuel injection valve are proposed. In these constitutions described in Patent Documents 1, 2, it is possible to dispose a drive motor in a vacant space generated in a case where a fuel injection valve is disposed in an intake tube, so that an increase in a size of the engine unit can be avoided.

Further, since the space in which the intake tube is provided is small, there is used a constitution in which the intake tube is extended to the inside of an air cleaner in order to obtain a necessary intake tube length. However, such a constitution causes a problem that a capacity of the air cleaner is decreased. In particular, in an engine where great importance is put on torque improvement in a low to medium rotation area, an intake tube length is tend to be set longer. In such an engine, the capacity of the air cleaner is decreased further, and output reduction (in particular, transient characteristic reduction) is brought about.

Besides, in an intake system of an engine unit of a motorcycle, in order to prevent output reduction due to intake interference, an independent throttle body in which a throttle valve is provided in each cylinder is adopted. Further, in order to improve an engine response by a throttle operation, a constitution in which a throttle valve is placed to a cylinder of an engine unit as close as possible is generally used.

However, in such an intake system, an intake inertia effect to be obtained becomes small in a slightly open region of the throttle valve. This is because in the slightly open region of the throttle valve, an intake tube length for obtaining the intake inertia effect is not a full length of an actual intake tube but is a length between an intake valve and the throttle valve. As a result, a charge efficiency of the slightly open region being a regular region becomes low. Then, a driver drives increasing a rotation number of an engine in order to obtain a necessary torque, bringing about aggravation of fuel consumption.

Further, the independent throttle body adopted in the motorcycle is manufactured by aluminum die casting. Such a constitution makes the independent throttle body heavier and more expensive, compared with a resin intake manifold for a four-wheel vehicle or the like.

[Patent Document 1] Japanese Laid-open Patent Publication No. 2002-256895

[Patent Document 2] Japanese Laid-open Patent Publication No. 2002-256896

In a conventional engine, in an intake system in particular, an intake tube is extended to the inside of an air cleaner, so that a substantial air cleaner capacity which can be used in an intake process of the engine is decreased by an amount of an inner capacity of the intake tube. An intake tube length is tend to be set longer in an engine aiming at torque improvement in a low and medium speed region in particular, and the air cleaner capacity is further decreased in such an engine, which results in output reduction (transient characteristic, in particular).

Further, in a layout of an independent throttle body type, an inertia effect obtained in a throttle valve subtly open region is small. This is because in the throttle valve subtly open region an actual intake tube full length is not an intake tube full length itself but a length from an intake valve to a throttle valve in a throttle body. As a result, a charging efficiency in the throttle valve subtly open region being a standard region is low, leaving no choice but to drive while increasing a rotation number in order to obtain a necessary torque, so that fuel consumption becomes worse if no measure is taken.

SUMMARY OF THE INVENTION

Under the circumstances, an object of the present invention is to provide an engine unit of a motorcycle, the engine unit securing sufficient intake tube length and air cleaner capacity and realizing compactification or the like effectively.

Further, an object of the present invention is to provide, in a motorcycle having a parallel multi-cylinder engine as an internal combustion engine, an engine unit of a motorcycle enabling a longer path of combustion air in an intake system without bringing about enlargement of a disposition space of the internal combustion engine.

An engine unit of a motorcycle according to the present invention is an engine unit of a motorcycle in which a plurality of cylinders are formed in parallel in a vehicle width direction and a cam chain chamber is formed on either one of sides in the vehicle width direction, the engine unit having: an air cleaner disposed above a main body of the engine unit and taking in and cleaning combustion air; one throttle body controlling a flow amount of the combustion air having been cleaned by the air cleaner; an intake pipe connecting the air cleaner and the throttle body in a manner that the combustion air is able to circulate; and an intake manifold distributing the combustion air whose flow amount is controlled by the one throttle body to the plurality of cylinders, wherein the one throttle body and the intake manifold are disposed above a crankcase assembly of the engine unit and behind a cylinder assembly of the engine unit, and wherein the throttle body is disposed in a position biased to a side on which the cam chain chamber is provided in terms of the vehicle width direction and in the rear diagonally downward of an intake port of the cylinder nearest to the cam chain chamber.

It is preferable that it is constituted so that the throttle body is disposed in a manner that a center axis of a throttle bore is almost in parallel to the vehicle width direction, and that an end part on a downstream side of the combustion air is coupled with the intake manifold and an end part on an upstream side of the combustion air is connected to the intake pipe.

It is preferable that it is constituted so that the intake manifold has the one manifold collecting section formed in a cylinder shape having a bottom and a plurality of intake tubes independent of each other and reaching the intake ports of the plurality of cylinders from the one manifold collecting section, and that the manifold collecting section is disposed coaxially with the center axis of the throttle bore of the throttle body on the downstream side of the combustion air of the throttle body, and is disposed on an inner side of a width of a cylinder head of the cylinder assembly in terms of the vehicle width direction.

It is preferable that it is constituted so that the plurality of intake tubes are bent in an arc shape in side view and are inclined in relation to a front and rear direction and extended in top view.

It is preferable that it is constituted so that a fuel injection device is disposed in a manner to protrude upward on an upper surface of the intake tube, and that the intake tube is constituted to overlap the intake pipe in side view.

It is preferable that it is constituted so that the throttle body is an electronic control type throttle body having a throttle valve and a drive motor driving the throttle valve, and that the drive motor is constituted to be positioned below the intake pipe in side view.

It is preferable that it is constituted so that the intake pipe is not extended to the inside of the air cleaner.

An engine unit of a motorcycle according to the present invention is an engine unit of a motorcycle in which a plurality of cylinders are disposed in parallel in a vehicle width direction and a clutch chamber is disposed in either one of the right and the left in the vehicle width direction, the engine unit having: an intake manifold, a fuel injection device, a throttle body, and an intake pipe disposed between a cylinder assembly and an air cleaner in an upper part of a crankcase assembly, wherein the throttle body is disposed on an opposite side in the vehicle width direction of the clutch chamber.

It is preferable that it is constituted so that a throttle bore center axis of the throttle body is set to be almost parallel to the vehicle width direction and that the throttle body is integrally fixed to the intake manifold.

It is preferable that it is constituted so that the throttle body is disposed on an inner side in the vehicle width direction of the cylinder assembly.

It is preferable that it is constituted so that the intake manifold includes a plurality of separated intake tubes connected to cylinder heads of respective cylinders and a manifold collecting section formed in a cylinder shape having a bottom, the manifold collecting section gathering the intake tubes integrally.

It is preferable that it is constituted so that the respective intake tubes are formed in curved shapes to round rearward in an upper part of the throttle body in side view and are disposed in a manner that inclines in relation to a longitudinal direction of the manifold collecting section are increased gradually or decreased gradually in rear view.

It is preferable that it is constituted so that the intake tube disposed farthest from the clutch chamber overlaps the throttle body in plan view.

It is preferable that it is constituted so that an engine is surrounded by a vehicle frame, that is, by a seat rail with regard to an upper part thereof, a down tube with regard to a front part, and a body tube with regard to a rear part, respectively, and that the fuel injection device, the intake tubes, a throttle valve, and its drive motor, from above in side view, are disposed tandem almost in parallel to a cylinder axis line in a space surrounded by the cylinder assembly, the air cleaner, and the crankcase assembly below the seat rail.

It is preferable that it is constituted so that the air cleaner is disposed in front of the body tube constituting the vehicle frame, and that the intake pipe connecting the throttle body and the air cleaner is connected without being extended to the inside of the air cleaner.

DETAILED DESCRIPTION OF THE PREFERRED EMBODIMENTS

First Embodiment

Hereinafter, a first embodiment of the present invention will be described in detail with reference to the drawings. In the following description, a direction of a motorcycle 1 is based on a direction of a driver riding on the motorcycle 1. In each drawing, an upper side of the motorcycle 1 is indicated by an arrow Tp, a lower side is indicated by an arrow Bt, a front side is indicated by an arrow Fr, a rear side is indicated by an arrow Rr, a right side is indicated by an arrow R, and a left side is indicated by an arrow L. In the description of the present embodiment, a right and left direction is a vehicle width direction. Further, a vehicle width center of the motorcycle 1 is indicated by a center line $C_B$.

Figure 1:
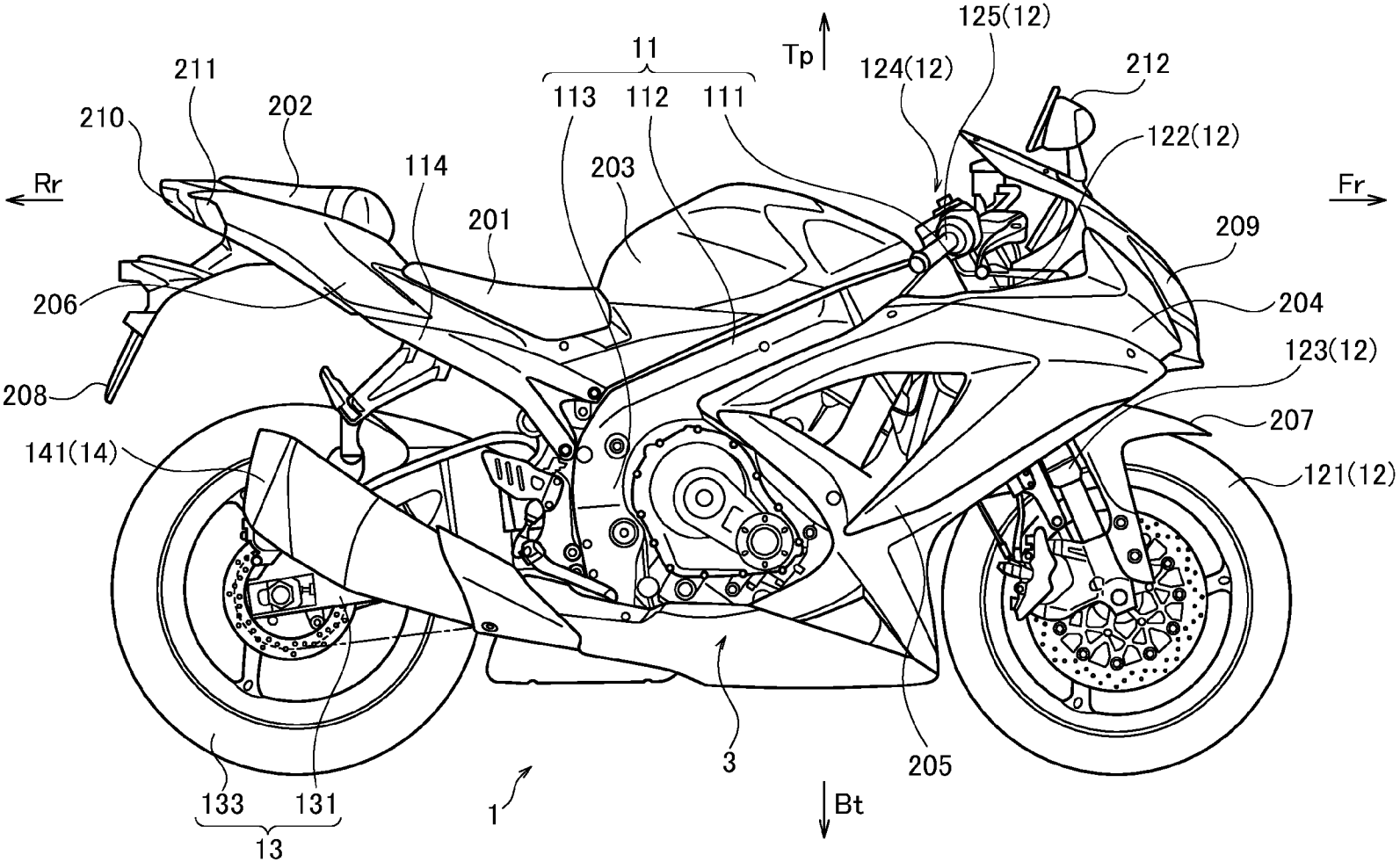
FIG. 1. is a right side view of a motorcycle to which an intake system according to a first embodiment is applied.
Figure 2:
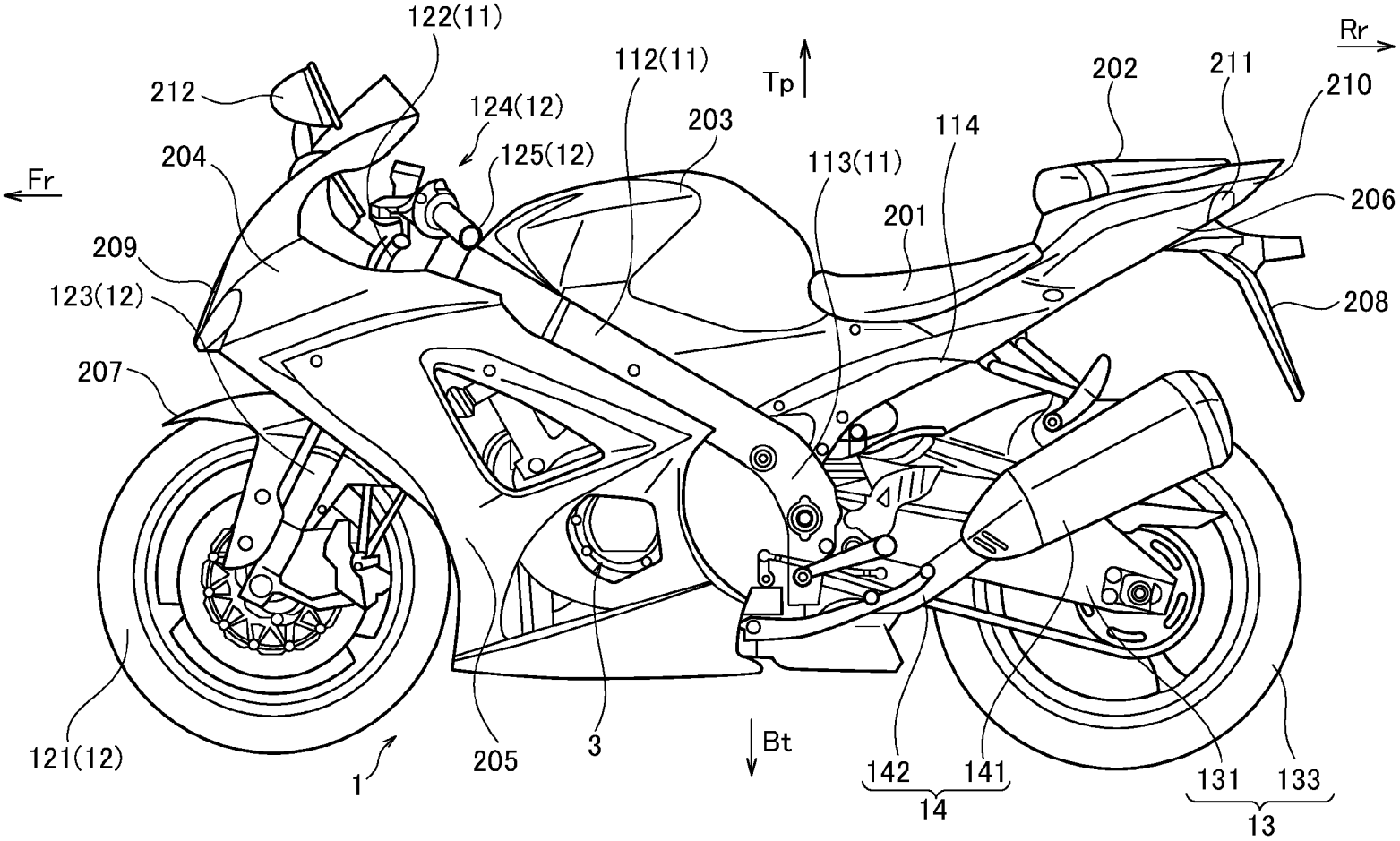
FIG. 2 is a left side view of a motorcycle to which the intake system according to the first embodiment is applied.

First, an overall configuration of the motorcycle 1 having an intake system 5 according to the present embodiment (hereinafter, referred to simply as the motorcycle 1) will be described with reference to FIG. 1 and FIG. 2. FIG. 1 is a right side view schematically showing the constitution of the motorcycle 1. FIG. 2 is a left side view schematically showing the constitution of the motorcycle 1. As shown in FIG. 1 and FIG. 2, the motorcycle 1 includes a vehicle body frame, a steering gear 12, an engine unit 3 as an internal combustion engine, and a rear wheel suspension system 13. An intake system 5 according to the present embodiment is applied to the engine unit 3.

A twin spar frame 11 is applied to the vehicle body frame. The twin spar frame 11 includes a steering head pipe 111, a right and left pair of side frames 112, and body frames 113. Each portion of the twin spar frame 11 is formed of, for example, an iron-based material or an aluminum alloy-based material, and is joined into a single unit by welding or the like.

The steering head pipe 111 is formed in a tube shape which inclines rearward. The right and left pair of side frames 112 extend from the steering head pipe 111 toward the rear diagonally outside respectively. The body frames 113 are provided on rear sides of the right and left pair of side frames 112, and are formed to extend from rear end parts of the right and left pair of side frames 112 almost downward, in rear view. Then, a space for housing the engine unit 3 is formed between the right and left pair of side frames 112, in top view.

Further, a right and left pair of seat rails 114 is provided on a rear side of the twin spar frame 11. The right and left pair of seat frames 114 is formed to extend from the body frames 113 toward the rear, respectively. Further, the right and left pair of seat rails 114 are apart from each other in a right and left direction (vehicle width direction) with a predetermined distance.

The steering gear 12 is provided in a front part of the twin spar frame 11 (vehicle body frames) rotatably in relation to the twin spar frame 11. The steering gear 12 is constituted by including a front wheel 121, a steering shaft 122, a right and left pair of front forks 123, and a handle unit 124.

The steering shaft 122 is rotatably supported by a steering head pipe 111. The right and left pair of front forks 123 is disposed in the right and left of the steering shaft 122. The front wheel 121 is rotatably supported by a lower end part on the right and left pair of front forks 123. The front wheel 12 is provided with a brake disk in a manner to rotate integrally. Besides, the right and left pair of front forks 123 is provided with a brake rim acting on the brake disk. The handle unit 124 is provided in upper end parts of the steering shaft 122 and the right and left pair of front forks 123. The handle unit 124 has a right and left handle grips 125. The handle grip 125 on the right side is provided with a throttle grip and a brake lever operating the brake rim of the front wheel 121. The throttle grip is rotatably provided in the handle grip 125 on the right side. Further, an accelerator position sensor (not shown) for detecting an operation amount (rotation angle) of the throttle grip is provided, for example, in the twin spar frame 11. The accelerator position sensor transmits a detected operation amount of the throttle grip to an ECU (described later). The handle grip 125 on a left side is provided with a clutch lever which operates a clutch. Further, the handle unit 124 is provided with a meter unit in which meters are unitized and switches for operating lights (neither is shown).

A parallel multi-cylinder engine (here, four-cylinder engine is exemplified) of a side cam chain type is applied to the engine unit 3 as the internal combustion engine. A main body of the engine unit 3 includes a cylinder assembly 31 and a crankcase assembly 32. In the cylinder assembly 31, a plurality of (here, four) cylinders 301 (combustion chambers) are formed parallel to each other in a manner to be aligned in the right and left direction. The crankcase assembly 32 is provided with a crankshaft, a counter shaft, and a driven shaft each in a rotatable manner. Besides, a drive chain sprocket transmitting a rotary motive power to a rear wheel 133 is provided in a left side rear part of the driven shaft.

The engine unit 3 is mounted on the twin spar frame 11. Then, a part of the engine unit 3 (here, a part of the cylinder assembly 31) is positioned between the right and left pair of side frames 112 of the twin spar frame 11.

Further, the engine unit 3 is provided with the intake system 5 which takes in combustion air from the outside and distributes to each cylinder 301. The intake system 5 includes an air cleaner 51, an intake pipe 52, a throttle body 53, and an intake manifold 54. The air cleaner 51 takes in combustion air from the outside and cleans. The throttle body 53 controls a flow amount of the combustion air. The intake manifold 54 distributes the combustion air to each cylinder 301. The intake pipe 52 is a flow path of the combustion air, and connects the air cleaner 51, the throttle body 53, and the intake manifold 54.

Note that a detailed constitution of the intake system 5 of the engine unit 3 will be described later.

The motorcycle 1 is provided with an ECU (Engine Control Unit), whose illustration is omitted. The ECU detects an operation of each section by the driver, and controls the engine unit 3 in correspondence with the detected operation. Note that the ECU is a computer which has an CPU, a ROM, and a RAM. As a result that the CPU reads and executes a computer program stored in the ROM, control of the engine unit 3 is realized.

The rear wheel suspension system 13 includes a right and left pair of swing arms 131, a shock absorber (hidden and not seen in the drawing), and the rear wheel 133. The rear wheel suspension system 13 is provided on a rear side of the twin spar frame 11, and is coupled with the body frames 113 in a vertically swingable manner.

A shock absorber is provided between the swing arm 131 and the body frame 113 or the seat rail 114, and absorbs or alleviates a vibration or an impulse transmitted from the swing arm 131 to the body frame 113 or the seat rail 114.

The rear wheel 133 is swingably supported by rear end parts of the swing arms 131. The driven sprocket is provided on a left side of the rear wheel 133 in a manner to rotate integrally. A drive chain is wound around a drive sprocket of the engine unit 3 and the driven sprocket of the rear wheel 133. A rotary motive power of the engine unit 3 is transmitted to the rear wheel 133 by the drive chain.

An exhaust system 14 includes a muffler 141 and an exhaust pipe 142. The muffler 141 is disposed behind the engine unit 3, beside the rear wheel 133. One end part (front end part) of the exhaust pipe 142 is connected to an exhaust port 303 of the cylinder assembly 31 of the engine unit 3. The other end part (rear end part) of the exhaust pipe 142 is connected to a front side of the muffler 141. Besides, the exhaust pipe 142 goes toward the front from a front side of the engine unit 3, bent toward the rear in front of the engine unit 3, passes beside or below the engine unit 3, and reaches the front side of the muffler 141.

A seat 201 (driver's seat) on which the driver is seated and a seat 202 (tandem seat) on which a passenger is seated are mounted on an upper side of the seat rail 114 in a detachable manner. The seats 201, 202 and the seat rail 114 are provided with rock mechanisms for fixing the seats 201, 202 to the seat rail 114. A fuel tank 203 is provided on an upper side of the right and left pair of side frames 112, and on a front side of the seats 201, 202.

Further, the motorcycle 1 is provided with a cover member covering the outer side. The cover member includes a front cover 204 covering a front part of the motor cycle 1, a side cover 205 covering a side part, and a rear cover 206 covering a rear part. These covering members are mounted on the twin spar frame 11, the front fork 123, or the like in a detachable manner. These covering members are shelf-shaped members, and are formed, for example, of a synthetic resin material or the like. These cover members form a design of an exterior appearance of the motorcycle 1 by covering the outer side of the motorcycle 1.

Other than the above, the motorcycle 1 is provided with a front fender 207 covering an upper side of the front wheel, a rear fender covering an upper side of the rear wheel, a headlight 209, a tail light 210, a winker 211 and a driver's mirror 212, and so on.

Figure 3:
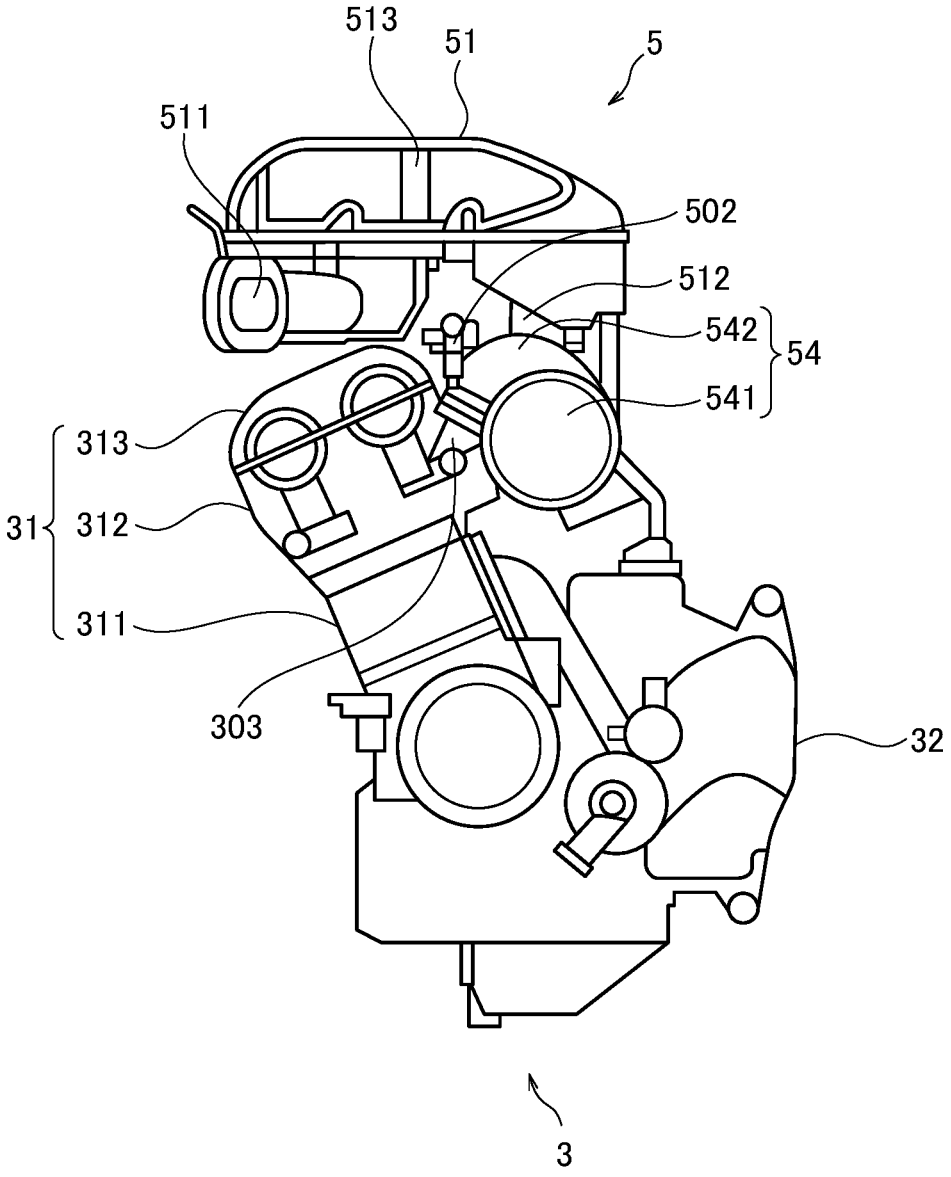
FIG. 3 is a left side view schematically showing constitutions of an engine unit and the intake system.
Figure 4:
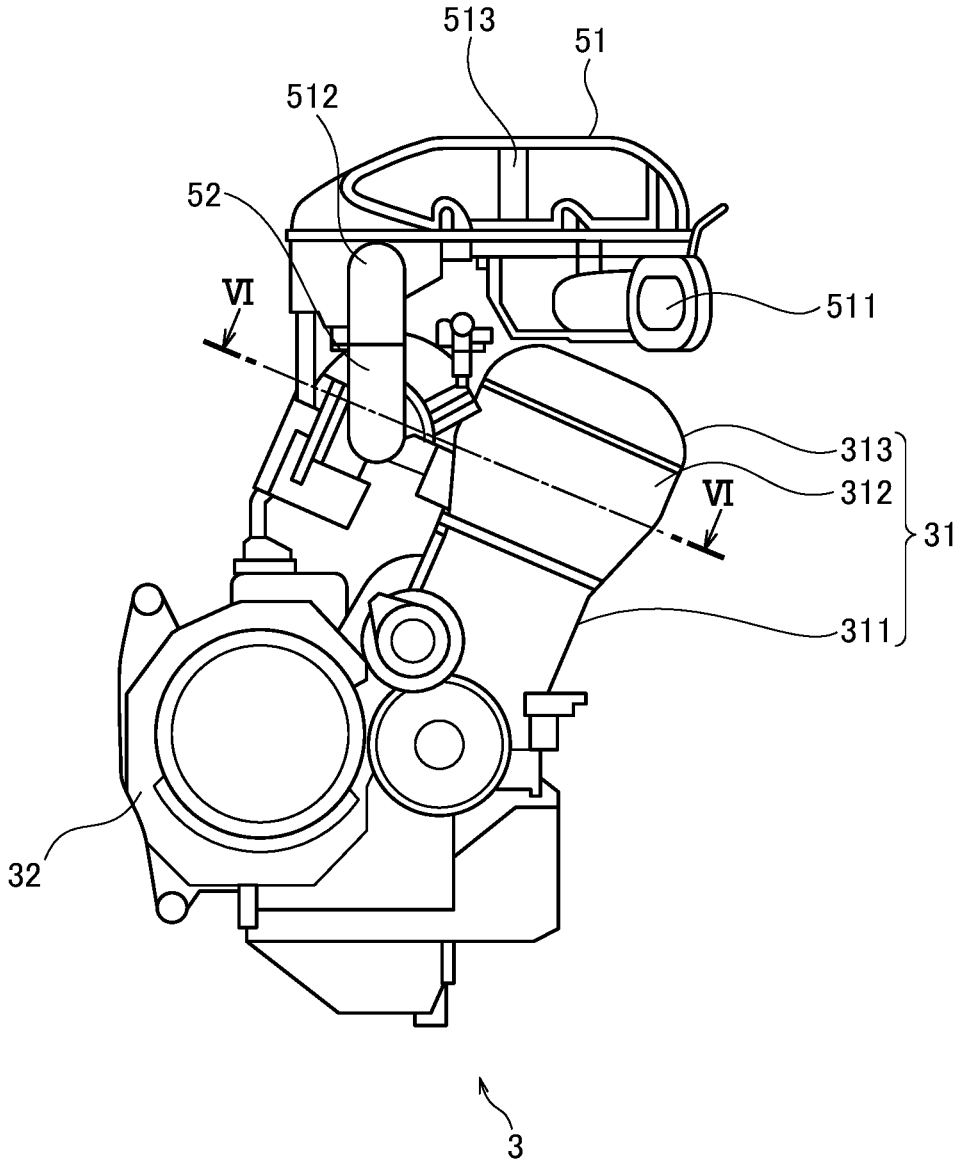
FIG. 4 is a right side view schematically showing constitutions of the engine unit and the intake system.
Figure 5:
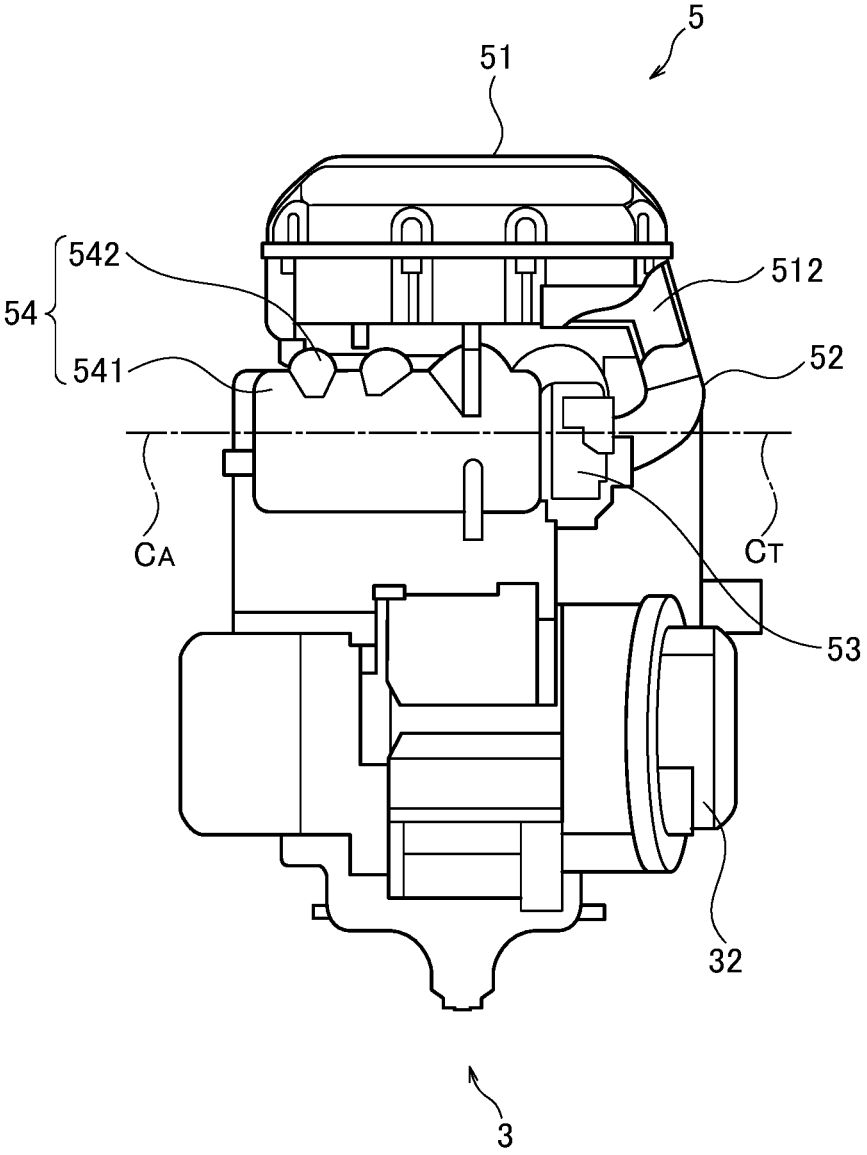
FIG. 5 is a rear view schematically showing constitutions of the engine unit and the intake system.
Figure 6:
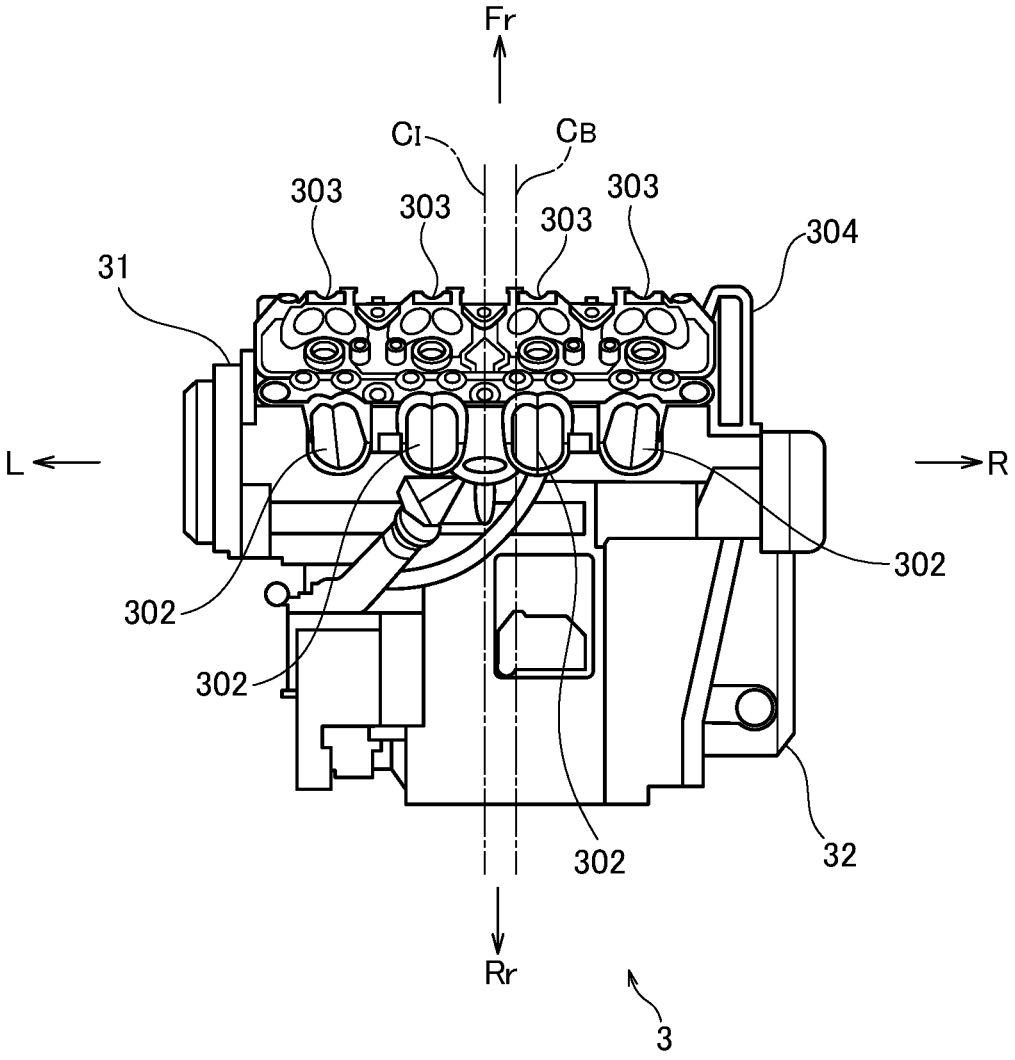
FIG. 6, being a cross-sectional arrow diagram taken along a VI-VI line of FIG. 4, is a diagram schematically showing the constitution of the engine unit.

Next, a constitution of the engine unit 3 will be described with reference to FIG. 3 to FIG. 6. FIG. 3 to FIG. 5 are drawings schematically showing overall constitutions of the engine unit 3 and its intake system 5. FIG. 3 is a right side view, FIG. 4 is a left side view, and FIG. 5 is a rear view. FIG. 6, being a cross-sectional arrow diagram taken along a VI-VI line of FIG. 4, is a diagram schematically showing an internal constitution of the engine unit.

As described above, the parallel multi-cylinder engine of a side cam chain type is applied to the engine unit 3. Note that in the present embodiment, though a parallel four-cylinder engine having four cylinders 301 (combustion chambers) formed in the engine unit 3 is exemplified, the number of the cylinders 301 is not limited thereto. It suffices if the engine unit 3 is a parallel multi-cylinder engine having a plurality of cylinders 301.

As shown in FIG. 3 to FIG. 5, the cylinder assembly 31 has a cylinder block 311, a cylinder head 312, and a cylinder head cover 313.

The plural (four) cylinders 301 are formed in the cylinder block 311. The plural cylinders 301, whose axial lines are almost parallel to one another, are formed in a manner to be aligned in the right and left direction (vehicle width direction). Besides, a piston is disposed inside each cylinder 301 in a manner to be able to reciprocate. Note that the axis lines of the plural cylinders 301 incline forward.

The cylinder head 312 is provided on an upper side of the cylinder block 311. As shown in FIG. 6, in the cylinder head 312 are formed, per each cylinder 301, an intake port 302 supplying air-fuel mixture of fuel and combustion air to each cylinder 301 and an exhaust port 303 leading out exhaust gas form each cylinder 301. Each intake port 302 is formed on a rear side of the cylinder head 312, and can take in the air-fuel mixture from the rear of the cylinder head 312. Each exhaust port 303 is formed on a front side of the cylinder head 312, and can lead out the exhaust gas to the front of the cylinder head. Further, in an upper part of the cylinder head 312, there is provided a valve moving device opening/closing each cylinder 301 and each intake port 302, and each exhaust port 303.

The cylinder head cover 313 is provided on an upper side of the cylinder head 312. The cylinder head cover 313 covers the valve moving device and so on from the upper side.

Here, the valve moving device provided in the cylinder head 312 and a drive mechanism thereof will be described briefly.

The valve moving device and its drive mechanism have an intake valve, an exhaust valve, an intake side cam shaft, an exhaust side cam shat, and a cam chain.

The intake valve opens/closes between each cylinder 301 and each intake port 302. The exhaust valve opens/closes between each cylinder 301 and each exhaust port 303. The intake side cam shaft has a cam driving each intake valve. The exhaust side cam shaft has a cam driving each exhaust valve. The intake side cam shaft and the exhaust side cam shaft are rotatably provided in the cylinder head 312 in a manner that their axis lines become parallel in the right and left direction. Note that conventional known configurations can be applied to all the intake valve, the exhaust valve, the intake side cam shaft, and the exhaust side cam shaft.

The driven sprocket is provided in an end part (in the present embodiment, right side end part) of each of the intake side cam shaft and the exhaust side cam shaft. Meanwhile, a crankshaft (described later) is provided with the drive sprocket. The cam chain is wound around the driven sprocket and the drive sprocket. Thereby, the intake side cam shaft and the exhaust side cam shaft rotate in synchronicity with the crankshaft, and each intake valve and each exhaust valve act in synchronicity with a rotation of the crankshaft.

As shown in FIG. 6, a cam chain chamber 304 is formed on either one of sides (in the present embodiment, right side) in the right and left direction of the cylinder assembly. The cam chain is housed in the cam chain chamber 304.

As described above, since the cam chain chamber 304 is formed on the one side of the cylinder assembly 31, a center $C_I$ of the intake ports 302 is biased from a vehicle width center $C_B$ to an opposite side (left side) of the side on which the cam chamber 304 is formed.

As shown in FIG. 3 to FIG. 5, the crankcase assembly 32 is provided on a lower side of the cylinder assembly 31. The crankshaft assembly 32 is provided with the crankshaft, a counter shaft, a driven shaft, the clutch, and a transmission system (speed change gear). The crankshaft, the counter shaft, and the driven shaft are provided inside the crankcase assembly 32 rotatably and in a manner to be almost parallel to one another.

The crankshaft is coupled with each piston provided in each cylinder 301 by a connecting rod. The crankshaft and the counter shaft are connected by the clutch in a manner that a rotary motive power is able to be on and off. The clutch is provided on a right side of the crankcase assembly 32. The transmission system is constituted between the counter shaft and the driven shaft.

A left side end part of the driven shaft protrudes to an outer side of the crankcase assembly 32, and the drive chain sprocket is provided in this left side end part. Besides, the drive chain is wound around the drive chain sprocket and the driven chain sprocket of the rear wheel 133.

The crankshaft, the counter shaft, and the driven shaft are disposed almost in parallel to one another in the right and left direction. The counter shaft is disposed behind the crankshaft, and further, the driven shaft is disposed behind the counter shaft. Thus, the crankcase assembly 32 projects from an lower side of the cylinder assembly 31 toward the rear. Therefore, the engine unit 3 as a whole has an almost L-shaped constitution in side view.

The intake system 5 has the air cleaner 51, the intake pipe 52, one throttle body 53, and the intake manifold 54. The air cleaner 51 takes in combustion air from the outside and cleans. The intake pipe 52 is a path for supplying the combustion air to the intake manifold 54. The throttle body 53 controls a flow amount of the combustion air. The intake manifold 54 distributes the combustion air to each cylinder 301.

The air cleaner 51 is provided above a main body of the engine unit 3. In particular, a front part of the air cleaner 51 is positioned above (directly above) the cylinder head cover 313. On the other hand, a rear part of the air cleaner 51 is positioned more rearward than the cylinder head cover 313.

The front part of the air cleaner 51 is provided with an intake portion 511 for taking in combustion air from the outside. The intake portion 511 has a constitution of a tube shape which protrudes from the front part of the air cleaner 51 toward the front diagonally outer side.

A filter element 513 cleaning the air having been taken in by filtration is provided inside the air cleaner 51.

A lead out portion 512 for supplying the cleaned combustion air is provided in a rear part of the air cleaner 51. More specifically, the lead out portion 512 is provided in a position from a side surface to a lower surface of a side (in the present embodiment, right side) on which the cam chain chamber 304 of the engine unit 3 is provided, in the rear part of the air cleaner 51. The lead out portion 512 has a constitution of a tube protruding downward. Note that the lead out portion 512 protrudes to the outside of the air cleaner 51 but does not protrudes to the inside thereof (see FIG. 5, FIG. 13).

The intake pipe 52, the throttle body 53, and the intake manifold 54 are disposed behind the cylinder assembly 31 and above the crankcase assembly 32. Further, since the rear part of the air cleaner 51 is positioned more rearward than the cylinder head cover 313, the throttle body 53 and the intake manifold 54 are positioned below the rear part of the air cleaner 51. In other words, on a rear side of the engine unit 3, a region whose front, upper part, and lower part are surrounded by the cylinder assembly 31, the crankcase assembly 32, and the air cleaner 51 is formed. The intake pipe 52, the throttle body 53, and the intake manifold 54 are disposed in this region.

Figure 7:
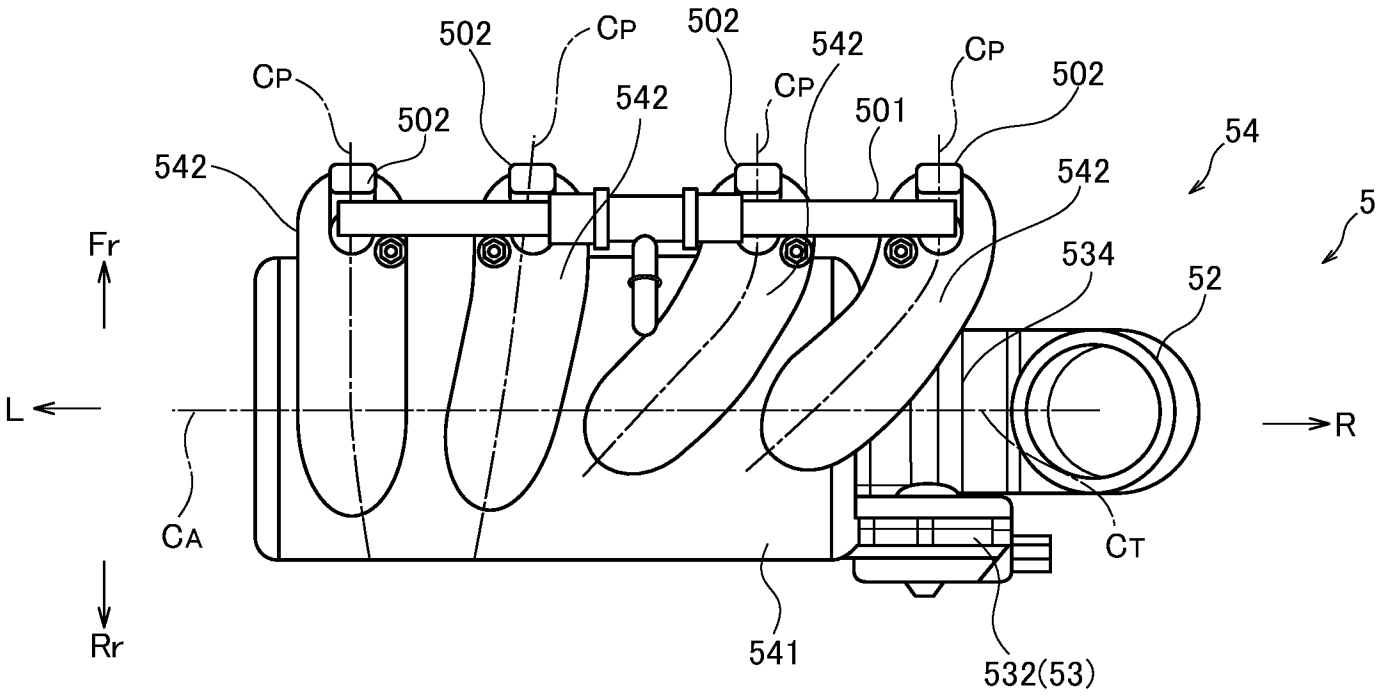
FIG. 7 is a top view schematically showing constitutions of an intake port, a throttle body, and an intake manifold.
Figure 8:
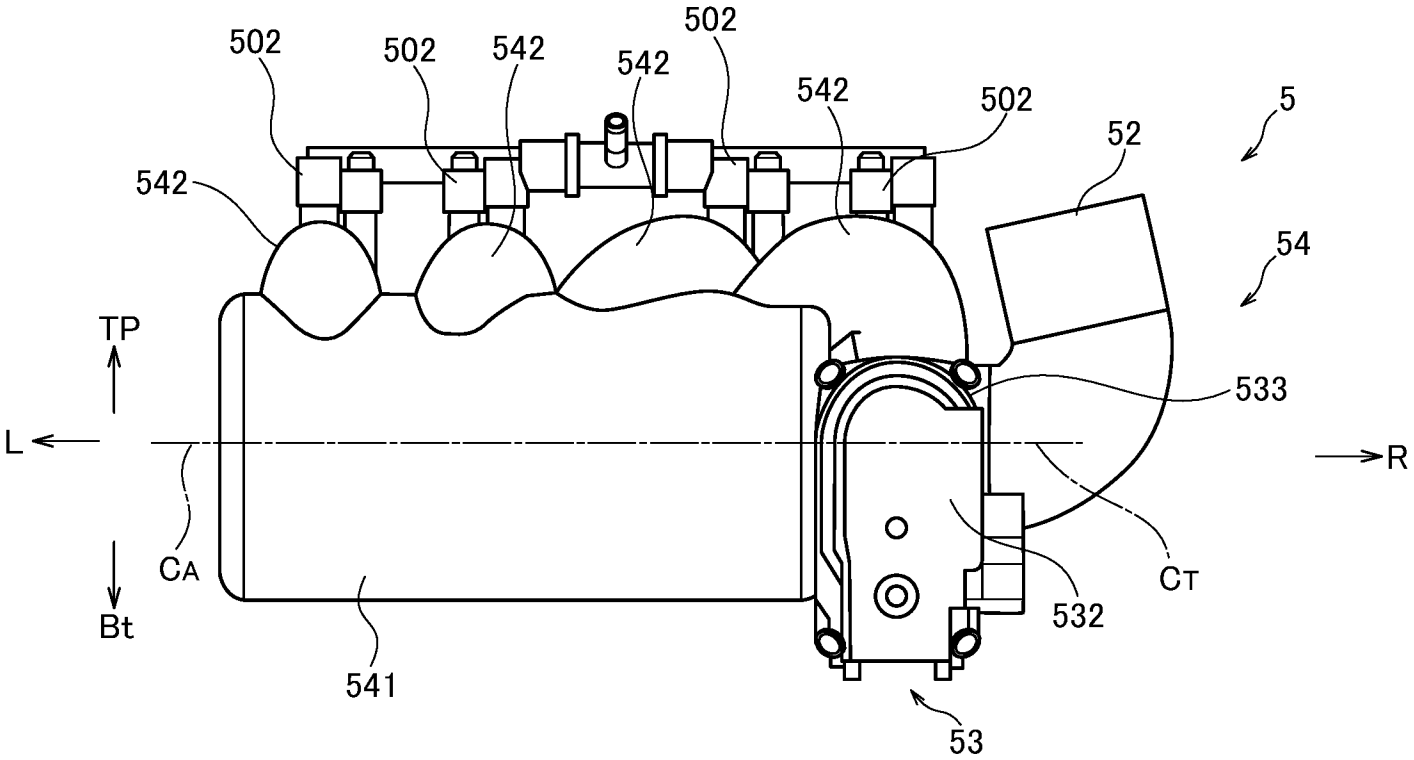
FIG. 8 is a rear view schematically showing the constitutions of the intake port, the throttle body, and the intake manifold.
Figure 9:
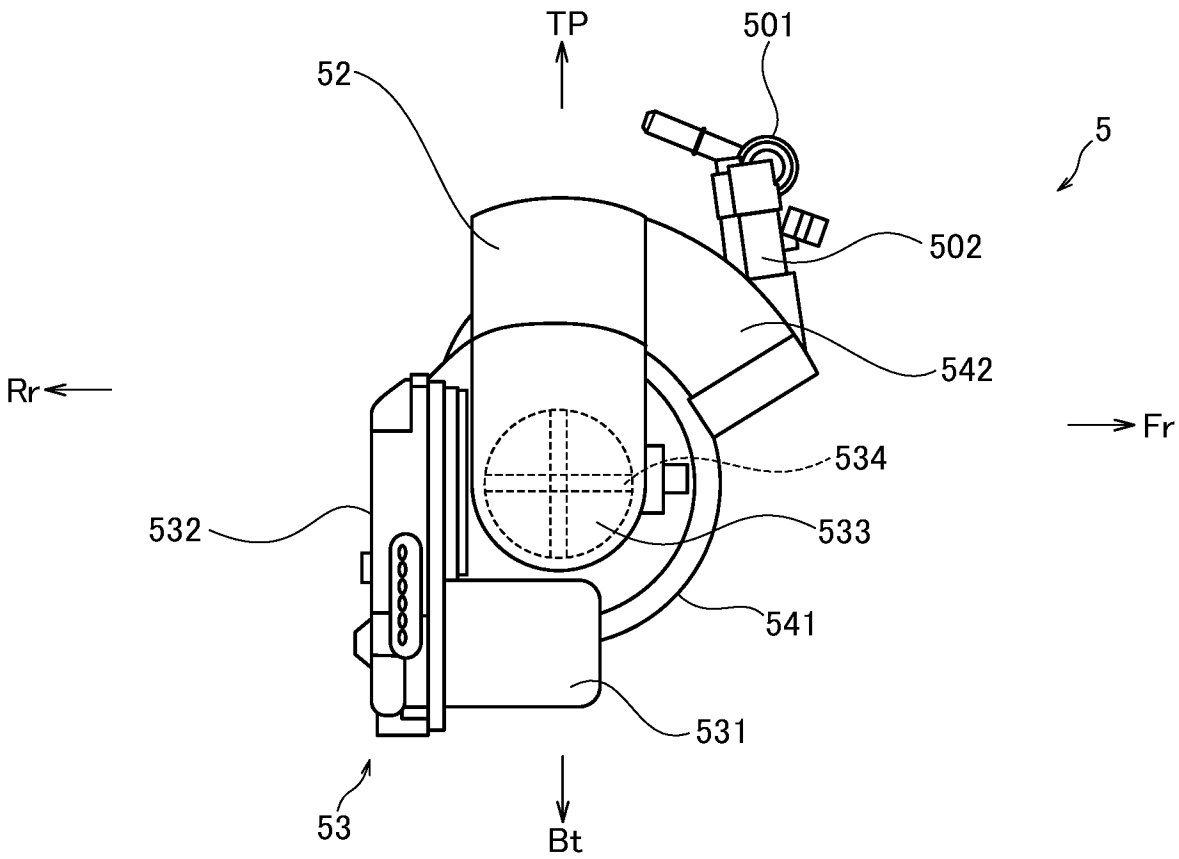
FIG. 9 is a right side view schematically showing the constitutions of the intake port, the throttle body, and the intake manifold.

Here, detailed constitutions of the intake pipe 52, the throttle body 53, and the intake manifold 54 will be further described with reference to FIG. 7 to FIG. 9. FIG. 7 to FIG. 9 are views schematically showing constitutions of the intake pipe 52, the throttle body 53, and the intake manifold 54. FIG. 7 is a top view, FIG. 8 is a rear view, and FIG. 9 is right side view, respectively. Note that in the following description "upstream side" and "downstream side" indicate an upstream side and a down stream side of the flow direction of combustion air in the intake system 5, respectively.

The intake pipe 52 has the tube-shaped constitution. An end part on the upstream side of the intake pipe 52 is connected to the lead out portion 512 of the air cleaner 51, while an end part on the downstream side is connected to the throttle body 53. An axis line of the end part on the upstream side of the intake pipe 52 is almost parallel to a top and bottom direction. On the other hand, an axis line of the end part on the downstream side of the intake pipe 52 is almost parallel to the right and left direction. An axis line of the intake pipe 52 is bent in a middle part. As described above, the intake pipe 52 makes combustion air supplied downward by the air cleaner 51 flow into the throttle body 53 from a right side (side on which the cam chain chamber 304 of the engine unit 3 is provided).

An electronic control type throttle body is applied to the throttle body 53. The throttle body 53 has a throttle valve 534 capable of changing an opening degree of a path 533 of combustion air, a drive motor 531 being a driving force source of the throttle valve 534, and a driving force transmitting mechanism portion transmitting a driving force of the drive motor 531 to the throttle valve 534. The ECU controls the drive motor 531 of the throttle body 53, in correspondence with an operation amount of the throttle grip detected by the accelerator position sensor. Thereby, a flow amount of the combustion air passing through the throttle body 53 is controlled.

The intake manifold 54 has one manifold collecting section 541 and a plurality, corresponding to the number of the intake ports 302, of (here, four) intake tubes 542. The intake manifold 54 is made of a resin material and manufactured by injection molding or the like. Or, the intake manifold 54 is made of aluminum and manufactured by casting. As just described, a resin molding product or an aluminum casting product leads to reduction in weight or manufacturing cost of the intake manifold 54.

The manifold collecting section 541 has a constitution of a cylinder shape having a bottom, and one end part (end part on the upstream side) in an axial direction is open, while the other end part (end part on the downstream side) is closed. In the drawing, the constitution of the manifold collecting section 541 formed in the cylinder shape is shown, but a cross-sectional shape of the manifold collecting section 541 is not limited to a circle. An axis line of the manifold collecting section 541 is parallel to the right and left direction, and the manifold collecting section 541 is disposed in a manner that the open end part on the upstream side is positioned on a side on which the cam chain chamber 30 of the engine unit 3 is provided and that the closed end part on the downstream side is positioned on a side opposite thereto. The manifold collecting section 541 is disposed in a position biased from the vehicle width center $C_B$ to an opposite side (left side) in the right and left direction of the cam chamber 304 (see FIG. 5 and so on).

Each intake tube 542 connects the manifold collecting section 541 and each intake port 302 of the cylinder assembly 31 in a manner that combustion air is flowable. In side view, an axis line of each intake tube 542 is bent in an arc shape projecting upward. More specifically, in side view, each intake tube 542 extends upward diagonally forward from an upper surface of the manifold collecting section 541 being a starting point, being bent in an arc shape to go along an outer peripheral surface of the manifold collecting section 541, reaches each intake port 302 from the rear diagonally upper side.

As described above, the intake manifold 54 has one manifold collecting section 541 and the plural intake tubes 542, and has a constitution in which the plural intake tubes 542 branch from the one manifold collecting section 541.

Further, center lines $C_p$ of at least two of plural intake tubes 542 incline by a predetermined angle in relation to the front and rear direction in top view. More specifically, as shown in FIG. 7 in particular, the three intake tubes 542 positioned on the upstream side of the manifold collecting section 541 incline in a manner to be displaced toward a side (here, right side) on which the cam chain chamber 304 is provided, as going from the manifold collecting section 541 (upstream side) of the intake manifold 54 toward each exhaust port 303 (downstream side). On the other hand, one intake tube 542 positioned on the most downstream side of the manifold collecting section 541 inclines in a manner to go toward an opposite side of the cam chain chamber 304, as going from the manifold collecting section 541 of the intake manifold 54 toward the intake port 302.

Further, a length of each intake tube 542 is set to be a length capable of maintaining synchronism of each cylinder 301. As described above, the manifold collecting section 541 of the intake manifold 54 has the cylindrical constitution, and each intake tube 542 extends from the outer periphery surface of the manifold collecting section 541. Therefore, as a result that a position in the front and rear direction of a starting point of each intake tube 542 is made different from each other, the length of each intake tube 542 can be set. According to such a constitution, the length of each intake tube 542 can be set individually without enlarging a dimension in the front and rear direction of the intake manifold 541. Thus, it is possible to set the length of the intake tube 542 to be a length necessary to obtain an inertia effect at a target rotation number and a length maintaining synchronism of each cylinder 301, without enlarging a dimension in the front and rear direction of the motorcycle 1. Therefore, it becomes possible to obtain a sufficient inertia effect in a whole area of opening degrees of the throttle valve 534. As a result, improvement of an output, improvement of a fuel consumption, reduction of a noise, and improvement of a cleaning efficiency can be done.

Further, each intake tube 542 is provided with an injector 502 being a fuel injection device for mixing fuel into combustion air. Further, a fuel pipe 501 supplying fuel to each injector 502 is provided in the front diagonally upward of the manifold collecting section 541 of the intake manifold 54. More detailedly, each injector 502 is provided on an upper surface of each intake tube 542 to protrude upward. The fuel pipe 501 is provided to be almost parallel to a center line $C_A$ of the manifold collecting section 541 of the intake manifold 54.

Here, an assembling constitution of the intake pipe 52, the throttle body 53, and the intake manifold 54 will be described.

As shown in FIG. 3 to FIG. 5 and FIG. 7 to FIG. 9, the throttle body 53 is provided on the side where the cam chain chamber 304 of the engine unit 3 is provided, the side being the end part on the upstream side of the manifold collecting section 541 of the intake manifold 54. In particular, the throttle body 53 is fixed in a manner to be integral with the manifold collecting section 541 of the intake manifold 54. Besides, the end part on the downstream side of the intake pipe 52 is connected to the end part on the upstream side of the throttle body 53. Further, the throttle body 53 is disposed in a manner that a center line $C_T$ (center axis of a throttle bore) of the path 533 of combustion air thereof is parallel to the right and left direction. Further, as described above, the center line $C_A$ of the manifold collecting section 541 of the intake manifold 54 and the axis line of the end part on the downstream side of the intake pipe 52 are also parallel to the right and left direction. As just described, the end part on the downstream side of the intake pipe 52, the throttle body 53, and the manifold collecting section 541 of the intake manifold 54 are aligned in series in the right and left direction. The throttle body 53 and the manifold collecting section 541 of the intake manifold 54 are disposed coaxially.

According to such a constitution, joining of the intake pipe 52 and the throttle body 53 can be done smoothly. Further, because of the constitution in which the throttle body 53 and the intake manifold 54 are disposed to be aligned in the right and direction, increase in dimension in the front and rear direction of the intake system 5 can be prevented or suppressed.

Further, as shown in FIG. 4 and FIG. 9, in side view, each intake tube 542 and the intake pipe 52 overlap each other. In other words, the intake pipe 52, in side view, whose axis line is almost parallel to the top and bottom direction, extends from the rear part of the air cleaner 51 downward and reaches a center of the intake manifold 54 from above. Thus, in side view, the intake pipe 52 overlaps an upper part of the manifold collecting section 541 of the intake manifold 54. On the other hand, each intake tube 542 of the intake manifold 54 reaches each intake port 302 of the engine unit 3, while being bent in an arc shape to project upward with the upper part of the manifold collecting section 541 being a starting point. Therefore, in side view, the intake pipe 52 overlaps at least a part of each of the respective intake tubes 542.

Further, as shown in FIG. 4, FIG. 9 and so on, the throttle body 53 is disposed in a manner that the drive motor 531 is placed below the path 533 of combustion air. In particular, as shown in FIG. 7, in top view, the throttle body 53 is disposed in a manner that the drive motor 531 of the throttle valve 534 overlaps the path 533 of combustion air. In other words, as shown in FIG. 4, FIG. 9 and so on, disposition positions of the drive motor 531 of the throttle body 53 and of the intake pipe 52 overlap each other in terms the forward and rear direction. Therefore, at least a part of the drive motor 531 of the throttle body 53 is positioned on a lower side (in particular, directly below) of a lower surface of the intake pipe 52 in side view. According to such a constitution, it is possible to prevent the drive motor 531 from protruding toward a rear side. Therefore, a dimension in the front and rear direction of the intake system 5 can be made smaller. Note that in the present embodiment there is shown a constitution in which a driving force transmission portion 532 of the throttle body 53 is positioned on the rear side of the intake pipe 52 in side view, but a constitution can be one where the driving force transmission portion 532 is positioned on a front side.

Figure 10:
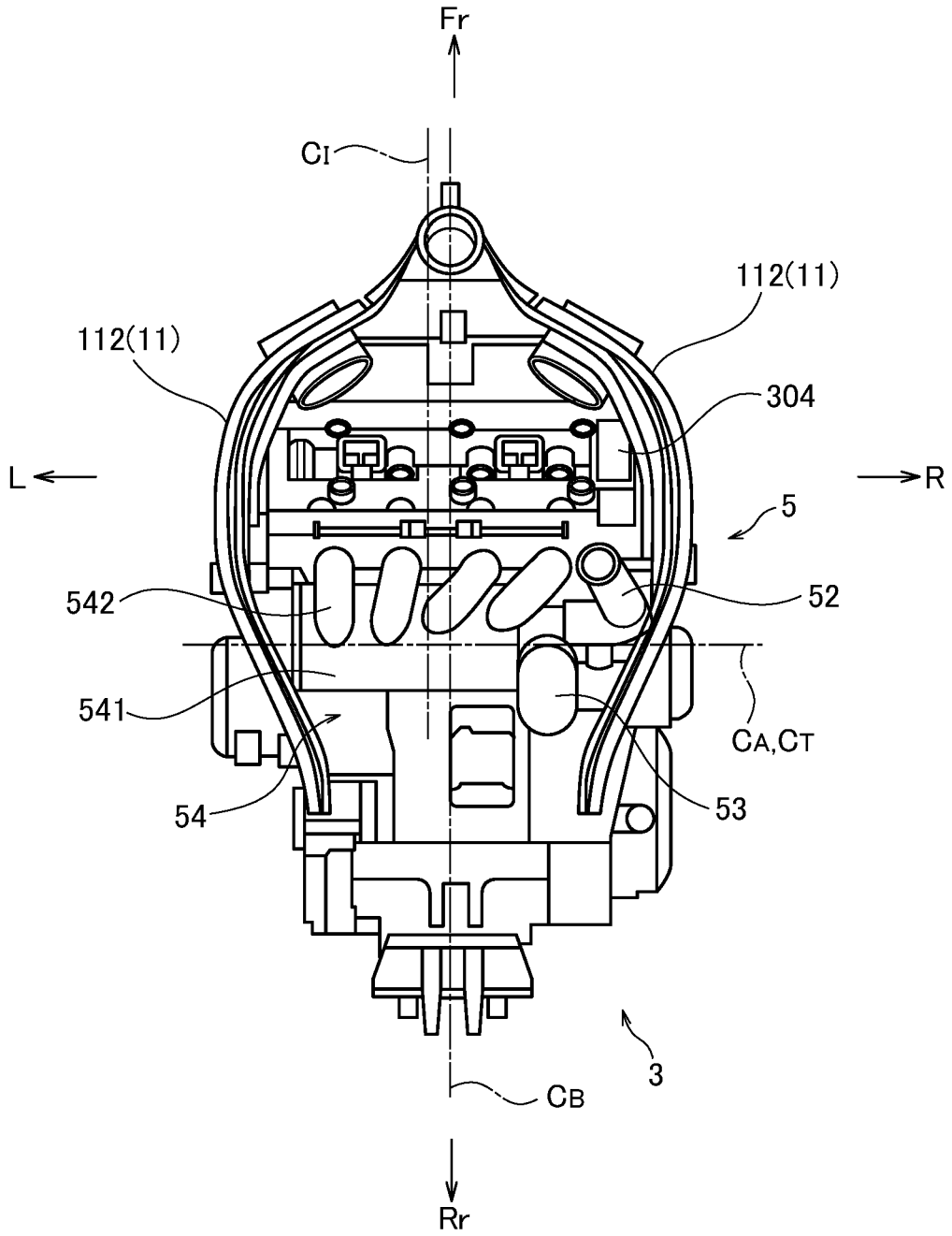
FIG. 10 is a top view schematically showing an assembling constitution of the engine unit and the intake system (excluding an air cleaner)
Figure 11:
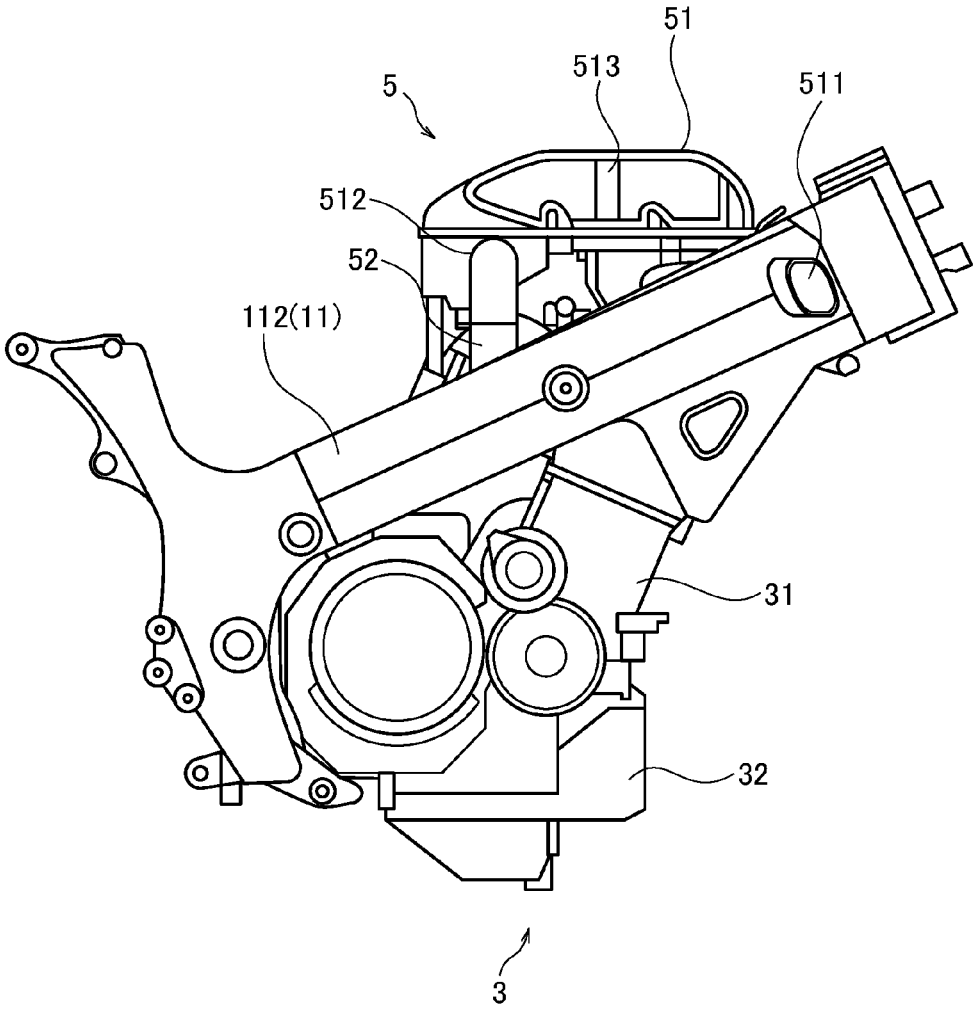
FIG. 11 is a right side view schematically showing the assembling constitution of the engine unit and the intake system.
Figure 12:
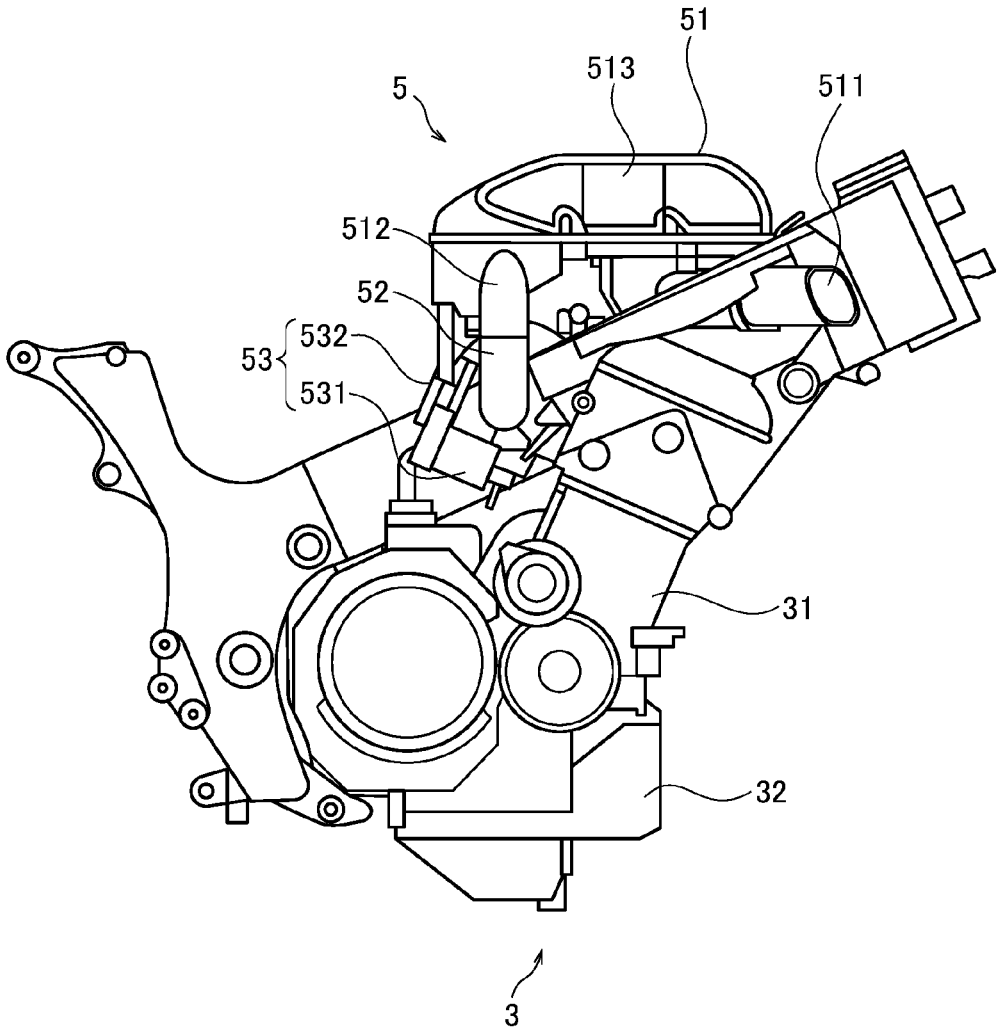
FIG. 12 is a right side view schematically showing the assembling constitution of the engine unit and the intake system, and is a view in which a side frame on a right side is deleted.
Figure 13:
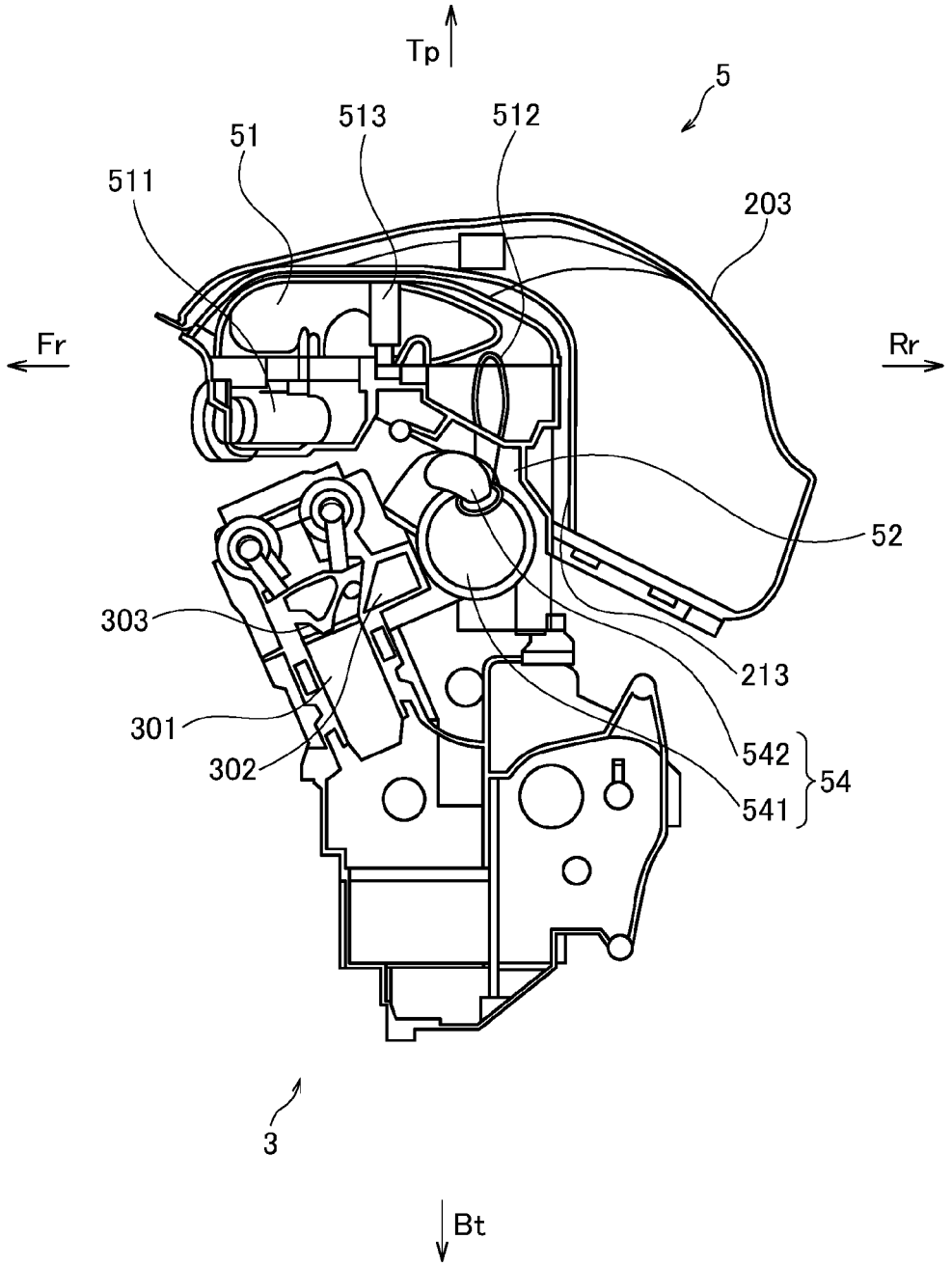
FIG. 13 is a cross-sectional view schematically showing a positional relationship between the engine unit and the intake system, and a fuel tank.

Next, positional relationships between the intake system 5 and the twin spar frame 11 and the fuel tank 203 will be described with reference to FIG. 10 to FIG. 13, and so on. FIG. 10 to FIG. 12 are views schematically showing the positional relationships between the engine unit 3 and its intake system 5, and the twin spar frame 11. FIG. 10 is a top view, FIG. 11 is a right side view, and FIG. 12 is a right side view showing the side frame 112 of the right side and so on being cut, respectively. FIG. 13 is a cross-sectional view of the engine unit 3, the intake system 5, and the fuel tank 203 which are cut along a vehicle width center $C_B$, and a view showing a relationship between the intake system 5 and the fuel tank 203.

As shown in FIG. 10, the cylinder assembly 31 of the engine unit 3, the intake pipe 52, the throttle body 53, and the intake manifold 54 are disposed between the right and left pair of side frames 112 of the twin spar frame 11 in top view.

The intake pipe 52 and the throttle body 53 are disposed in positions biased from the vehicle width center $C_B$ to a side on which the cam chain chamber 304 is formed in terms of the right and left direction. On the other hand, the intake manifold 54 is disposed in a position biased from the vehicle width center $C_B$ to the opposite side of the cam chain chamber 304 in terms of the right and left direction. Then, as shown in FIG. 10 and so on, the intake pipe 52, the throttle body 53, and the intake manifold 54 are positioned, in top view, behind the cylinder head 312, and in the inner side than a full width of the cylinder head 312 in terms of the right and left direction. More specifically, the disposition is as follows.

The engine unit 3 is of a side cam chain type, and the cam chain and the cam chain chamber 304 are provided on either one of sides (here, right side) in the right and left direction of the cylinder assembly 31. Thus, the cylinder 301 and the center $C_I$ of the intake ports 302 of respective cylinders 301 are biased from the vehicle width center $C_B$ to an opposite side of the side on which the cam chain chamber 304 is provided. Then, the intake manifold 54 is disposed in a position biased from the vehicle width center $C_B$ to the opposite side of the cam chain chamber 304 in terms of the right and left direction, in correspondence with bias of the intake port 302. Therefore, a space is formed behind the cam chain chamber 304 of the engine unit 3. The intake pipe 52 and one throttle body 53 are disposed in this space behind the cam chain chamber 304. In particular, as shown in FIG. 10 and FIG. 12, the throttle body 53 is disposed in the rear diagonally downward of the intake port 302 of the cylinder 301 nearest to the cam chain chamber 304.

According to such an assembling constitution, it is possible to dispose the intake pipe 52, the throttle body 53, and the intake manifold 54 in the inner side than the full width of the cylinder head 312 in terms of the right and left direction. Thus, it is possible to dispose the intake pipe 52 and the throttle body 53 without enlarging a distance between the right and left pair of side frames 112 of the twin spar frame 11. Therefore, an increase in dimension in the right and left direction of the twin spar frame 11 can be prevented.

On the other hand, a constitution of the present embodiment is not a constitution in which a throttle body is provided in each intake port 302, but is a constitution in which one throttle body 53 controls supply amounts of combustion air of all the intake ports 302. According to such a constitution, it suffices if one throttle body 53 is disposed in the position biased from the vehicle width center $C_B$ to the side of the cam chain chamber 304 of the cylinder head 312. Thus, a disposition space of the intake manifold 54 can be made larger. Therefore, compared with the constitution having individual throttle bodies, a passing path of combustion air in the intake manifold 54 can be made longer. Conventionally, an end part on an upstream side of an intake pipe 52 is extended to the inside of an air cleaner 51 in order to make a passing path of combustion air longer. In contrast, in the present embodiment, the passing path of combustion air can be made longer without extending the intake pipe 52 to the inside of the air cleaner 51. Therefore, decrease in capacity of the air cleaner 51 can be prevented.

As shown in FIG. 13, the fuel tank 203 is disposed above the engine unit 3. Further, the air cleaner 51 is disposed above the engine unit 3, and the intake pipe 52, the throttle body 53, and the intake manifold 54 are disposed behind the cylinder assembly 31 of the engine unit 31. Thus, in order to avoid interference with such an intake system 5, a recess 213 recessed toward an upper side is formed in a lower part of the fuel tank 203. At least a part of the intake system 5 gets into this recess 213.

According to the present embodiment, since the dimension in the front and rear direction of the intake system 5 can be made smaller, interference between the intake system 5 and the fuel tank 203 can be made smaller, so that the recess 213 formed in the fuel tank 203 can be made smaller. Therefore, decrease of a capacity of the fuel tank 203 can be prevented or suppressed. In other words, a constitution in which a recess 213 is formed on a lower side of the fuel tank 203 decreases a capacity of a fuel tank 203 by a capacity of the recess 213. Thus, when the recess 213 becomes larger, the capacity of the fuel tank 203 is decreased. In order to make the capacity of the fuel tank 203 larger with the recess 213 being as it is, it is necessary to enlarge an outside dimension of the fuel tank 203. This leads to increase in size of the motorcycle 1. In contrast, according to the constitution of the present embodiment, since the dimension in the front and rear direction of the intake system 5 can be made small, a dimension of the recess 213 formed in the fuel tank 203 can be made small. Therefore, it is possible to prevent interruption with the intake system 5 and to make the capacity of the fuel tank 203 larger without increasing the outside dimension.

Actions and effects of the intake system 5 according to the present embodiment are summarized as follows.

In the multi-cylinder parallel engine of the side cam chain type, the center $C_I$ of the intake ports 302 is biased from the vehicle width center $C_B$ to the opposite side of the cam chain chamber 304 in terms of the right and left direction. Thus, a space is formed behind the cam chain chamber 304, in a range from the cylinder 301 nearest to the cam chain chamber 304 to the outer side end of the cylinder head 312. The intake pipe 52 which connects the air cleaner 51 disposed on the upper side of the engine unit 3 and the throttle body 53 is disposed in this space. According to such a constitution, it is possible, without broadening a width of the right and left pair of side frames 112 disposed on both outer sides of the engine unit 3, to dispose the intake pipe 52 therebetween.

Besides, one throttle body 53 is disposed closer to the vehicle width center $C_B$ than the intake pipe 52, in the rear diagonally downward of the intake port 302 of the cylinder 301 nearest to the cam chain chamber 304. According to such a constitution, the intake pipe 52 can be disposed as described above, in consideration of assembling of the intake pipe 52 and the throttle body 53.

When the constitution is such that the throttle body 53 is disposed being biased to the side on which the cam chain chamber 304 is provided in terms of the right and left direction, the space for disposing the intake manifold 54 can be secured behind the cylinder head 312. All the intake tubes 542 of the intake manifold 54 gather in one manifold collecting section 541, and the amount of combustion air is controlled by one throttle body 53. Therefore, according to such a constitution, it is possible to make the passing path of combustion air in the intake system 5 have a length necessary for obtaining an inertia effect.

The throttle body 53, the center line $C_T$ (center axis of a throttle bore) of the path 533 of combustion air being disposed almost in parallel to the right and left direction (vehicle body direction), is integrally fixed to the manifold collecting section 541 of the intake manifold 54. Further, the intake pipe 52 is connected to the throttle body 53. Besides, the throttle body 53 is disposed in the position biased to the side on which the cam chain chamber 304 is provided in a manner that the center line $C_T$ of the path 533 of combustion air is parallel to the right and left direction. Thus, it is possible to connect the throttle body 53 and the intake pipe 52 smoothly. Further, the intake manifold 54 is disposed on the opposite side of the cam chain chamber 304, when viewed from the throttle body 53, coaxially with the center line $C_T$ of the path 533 of combustion air of the throttle body 53. Thus, it is possible to make the dimension in the front and rear direction of the intake system 5 as a whole smaller. Therefore, the motorcycle 1 can be made compact. Further, since the dimension in the front and rear direction of the intake system 5 can be made smaller, interference between the intake system 5 and the fuel tank 203 can be prevented or reduced. Therefore, decrease of the capacity of the fuel tank 203 can be prevented or suppressed.

The intake manifold 54 has one manifold collecting section 541 and the plural intake tubes 542. The plural intake tubes 542 extend from the manifold collecting section 541 independently of each other and are linked to respective cylinders 301. In other words, the plural intake tubes 542 integrally gather in the manifold collecting section 541. The manifold collecting section 541 of the intake manifold 54 is disposed behind the cylinder assembly 31, and above the crankcase assembly 32. Further, the manifold collecting section 541 of the intake manifold 54 is disposed coaxially to the center line $C_T$ of the path 533 of combustion air of the throttle body 53. Further, the manifold collecting section 541 of the manifold 54 is disposed on the downstream side of the throttle body 53, and nearer to the vehicle width center $C_B$ than a full width of the cylinder head 312. According to such a constitution, it is possible to have an effect similar to the above.

The intake tube 542 of the intake manifold 54 is formed to be bent in an arc shape in side view. Further, the plural of two or more intake tubes 542 are formed in a manner that their center lines $C_P$ incline in the front and rear direction in top view. More specifically, the intake tubes 542 incline in a manner to move to the side of the cam chain chamber 304, as going from the upstream side (side of the manifold collecting section 541) to the downstream side (side of the intake port 302).

According to such a constitution, it is possible to secure a length of the intake tube 542 necessary for obtaining an inertia effect at a target rotation number. Further, the length of the intake tube 542 can be changed to maintain synchronism of each cylinder 301 without enlarging the dimension in the front and rear direction of the intake system 5. Thus, a sufficient inertia effect can be obtained in the whole area of opening degrees of the throttle valve 524. Therefore, improvement of the output, improvement of the fuel consumption, reduction of the noise, and improvement of the cleaning efficiency can be done.

The injector 502 is disposed on an upper surface of each intake tube 542 of the intake manifold 54 in a manner to stand almost vertically (in a manner to protrude upward). The intake tube 542 of the intake manifold 54 and the intake pipe 52 overlap each other in side view. According to such a constitution, the dimension in the front and rear direction of the intake system 5 as a whole can be made smaller while the length of the intake tube 542 is secured to be a length sufficient for obtaining an inertia effect.

An electronic control type throttle body is applied to the throttle body 53. The drive motor 531 for driving the throttle valve 534 is disposed to be positioned below the intake pipe 52 in side view. In other words, in top view, the drive motor 531 overlaps the path 533 of combustion air of the throttle body 53. According to such a constitution, the dimension in the front and rear direction of the intake system 5 as a whole can be made smaller. Therefore, it becomes possible to dispose the intake system 5 in a small space.

In the present embodiment, as described above, the intake tube 542 can be formed to have a length sufficient for obtaining an inertia effect. Thus, the intake pipe 52 connecting the air cleaner 51 and the throttle body 53 is not required to be extended to the inside of the air cleaner 51. With the constitution in which the intake pipe 52 is not extended to the inside of the air cleaner 51, the capacity of the air cleaner 51 is not reduced. Therefore, an input can be improved.

Second Embodiment

Next, a second embodiment of the present invention will be described.

Figure 14:
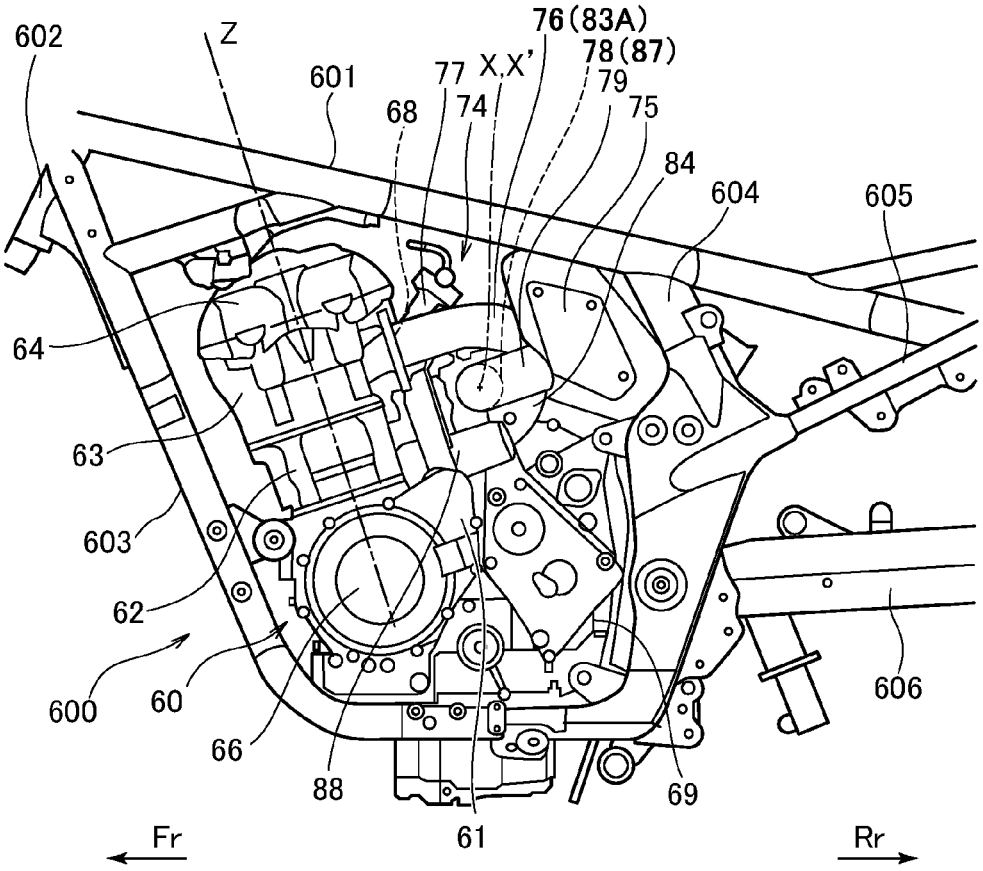
FIG. 14 is a left side view showing a state where a power unit is mounted on a vehicle body frame in a motorcycle according to a second embodiment.
Figure 15:
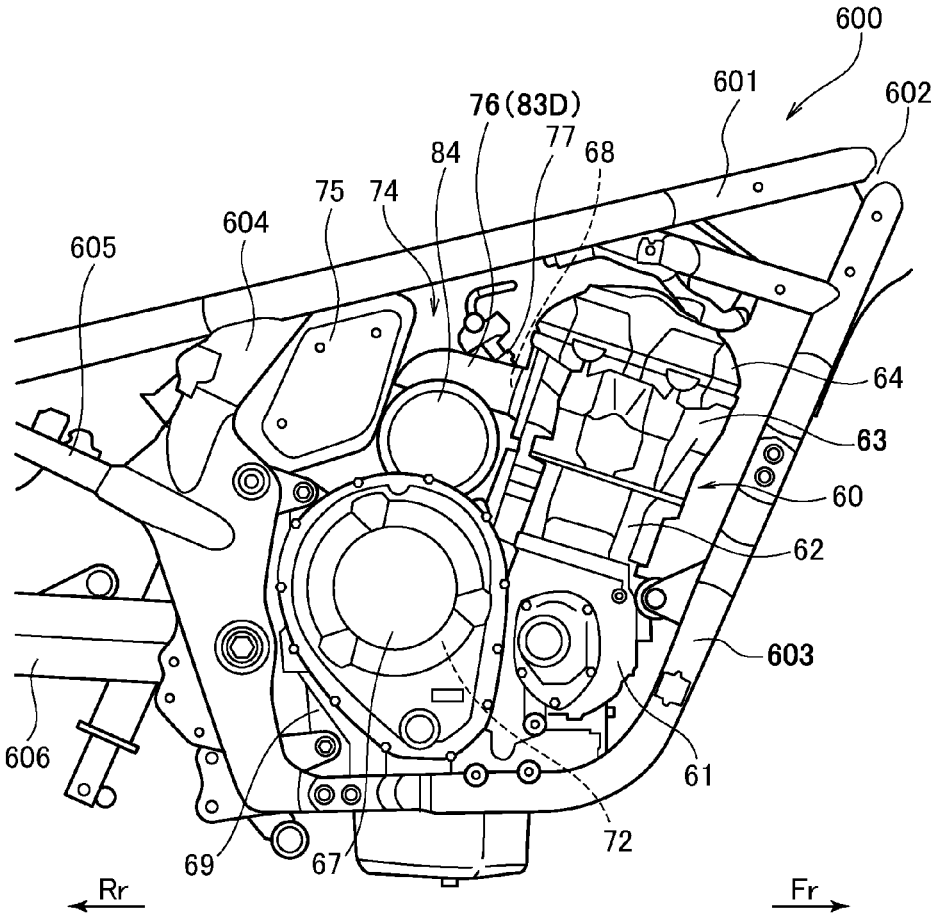
FIG. 15 is a right side view showing the state where the power unit is mounted on the vehicle body frame in the motorcycle according to the second embodiment.
Figure 16:
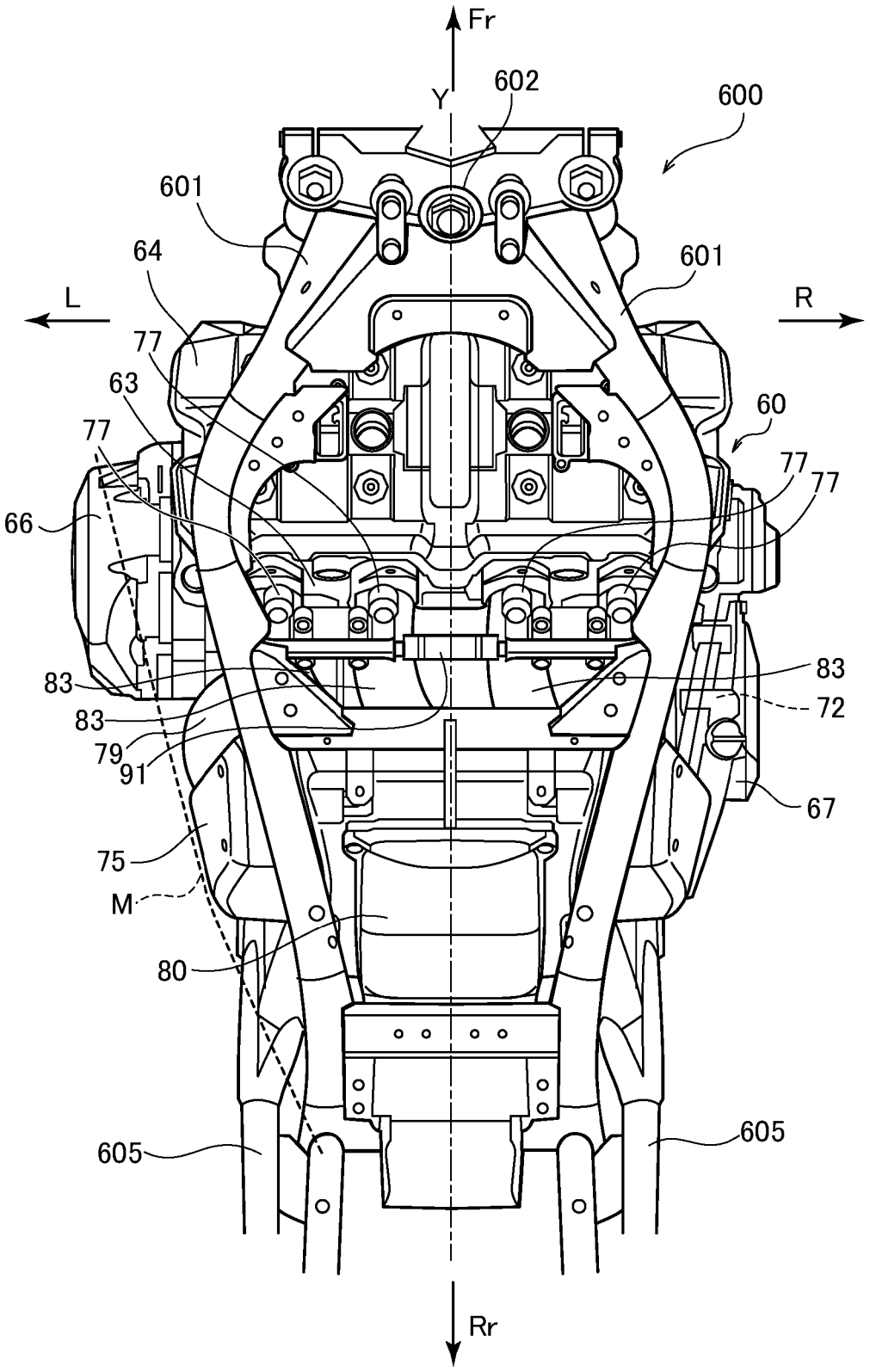
FIG. 16 is a top view showing the state where the power unit is mounted on the vehicle body frame in the motorcycle according to the second embodiment.

FIG. 14 is a left side view showing a state where an engine unit is mounted on a vehicle body frame in a motorcycle according to the present embodiment, FIG. 15 is a right side view thereof, and FIG. 16 is a top view thereof. A neighborhood of the engine unit will be described by using FIG. 14 to FIG. 16. Note that in the drawings used in the following description, a front of a vehicle is indicated by an arrow Fr, a rear of the vehicle is indicated by an arrow Rr, respectively, and a lateral right side of the vehicle is indicated by an arrow R, and a lateral left side of the vehicle is indicated by an arrow L, respectively, as appropriate.

In a motorcycle 600, a seat rail 601 made of steel or an aluminum alloy material is connected to a rear part of a steering head pipe 602, a right and left pair branching rearward, once widening from the steering head pipe 602, and extending diagonally downward. A down tube 603 also extends downward by a steep angle from the steering head pipe 603, and is bent rearward at a lower end part thereof. Further, a body tube 604 extends diagonally downward from around a rear part of the seat rail 601, and a rear end part on the seat rail 601 is connected to a side tube 605 which inclines properly to rise rearward, and a vehicle body frame is constituted by the above frames. The vehicle body frame has a shape of almost a basket inside which a housing space for an engine unit 60 is formed, and the engine unit 60 is mounted as shown in the drawing.

Although illustration is omitted, an entire constitution of the motorcycle 600 will be described in summary. The motorcycle 600 is provided with a right and left pair of two front forks supported by the steering head pipe 602 in a pivotal manner from side to side. A handle bar is fixed to an upper end of the front fork, and a front wheel is rotatably supported at a lower end part thereof. Further, a swing arm 606 (see FIG. 14 and so on) is swingably coupled on a rear side of the engine unit 60, and a rear wheel is rotatably supported by an end part thereof. The rear wheel is configured to be rotation-driven via a driven sprocket around which a chain transmitting a motive power of the engine unit 60 is wound.

A fuel tank is mounted above the engine unit 60 mounted on the vehicle body frame, and fuel is supplied from the fuel tank by a fuel supply system and air is supplied from an air cleaner constituting a later-described intake system. Air-fuel mixture made of such fuel and air is supplied to the engine unit 60 and exhaust gas after combustion in an engine is exhausted through an exhaust pipe.

Figure 17:
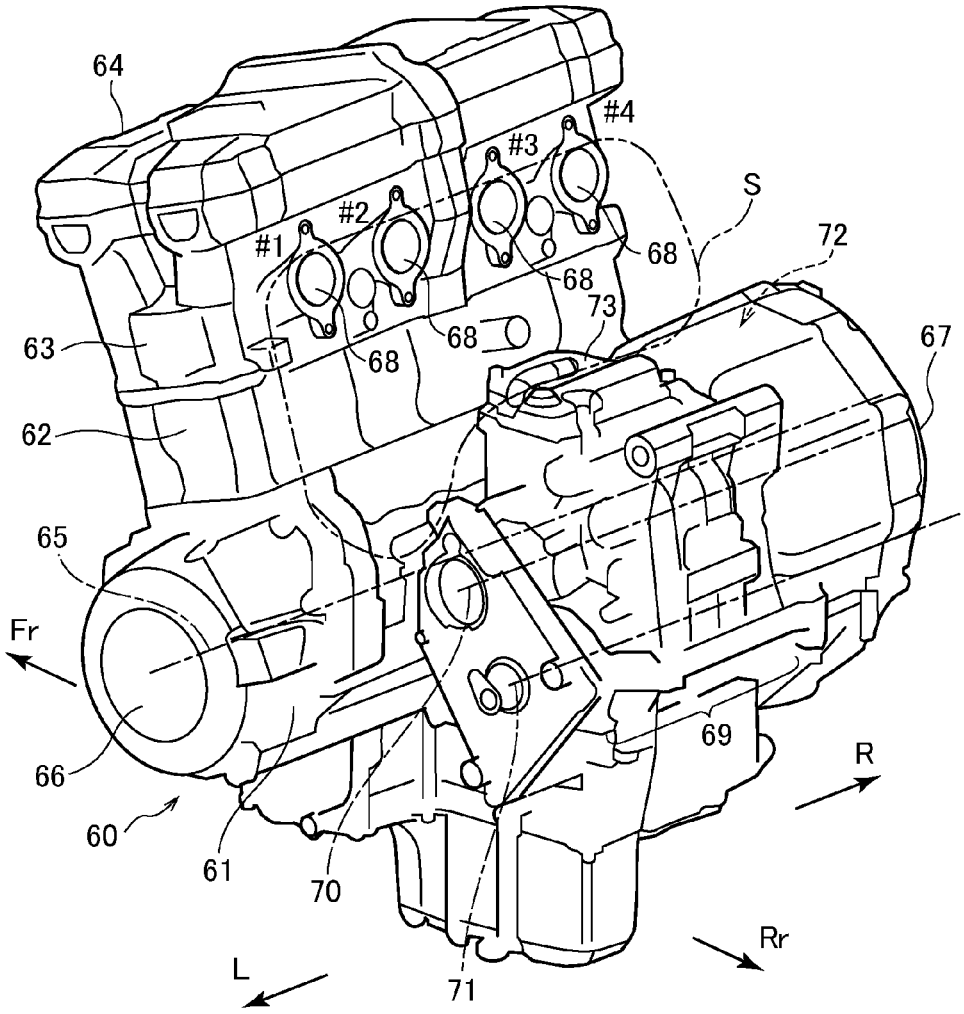
FIG. 17 is a rear perspective view showing the power unit from which an intake system is removed in the second embodiment.

Next, a constitution example of the engine unit 60 (internal combustion engine) in the present embodiment will be described. The engine unit 60 of the present embodiment, as shown in FIG. 17, is made as a result that a cylinder block 62, a cylinder head 63, and a cylinder head cover 64 are integrally united in sequence on an upper part of a crankcase assembly 61, and the above forms a cylinder assembly. The cylinder assembly is disposed in a posture inclining forward properly. Further, the engine unit 60 is integrally unite-supported by the vehicle body frame by being suspended by the down tube 603 and so on via a plurality of engine mounts. In this example, four cylinder blocks 62 are disposed in parallel in a right and left (vehicle width) direction, and a piston is fit into each cylinder bore of the cylinder block 62 in a freely slidable manner in a cylinder axis direction. Note that the cylinder blocks are No. 1 (#1), No. 2 (#2), No. 3 (#3), and No. 4 (#4) cylinders (combustion chambers) in sequence from the left side. A center line (FIG. 16, vehicle center line Y) in a vehicle front and rear direction is set to pass almost between the #2 cylinder and the #3 cylinder.

The crankcase assembly 61, upper and lower halved upper crankcase and lower crankcase being united with each other, supports a shaft of a crankshaft 65 or the like by a uniting surface thereof. In the crankcase assembly 61, the crankshaft 65 (outlined by a dashed line in FIG. 17) is disposed in the vehicle width direction. In this case, a plurality of journal portions of the crankshaft 65 is axially supported by a plurality of journal bearing portions set in the joining surface of the crankcase assembly 61. A generator which includes a generator coil and a generator rotor is disposed and constituted in a left shaft end part of the crankshaft 65. In this case, the generator coil is attached and supported by an inner side of a magneto cover 66. Note that a sprocket for driving a cam being a valve moving device is attached to a right shaft end part of the crankshaft 65.

A valve moving device open/close controlling an intake valve and an exhaust valve is housed in the cylinder head 63. These valves are driven by an intake cam and an exhaust cam provided in an intake cam shaft and an exhaust cam shaft, respectively. Each cylinder has an intake port 68 which opens toward the rear of the cylinder head 63 and flowing into the cylinder of air-fuel mixture supplied from the intake system to the intake port 68 is controlled by the intake valve.

A rear part of the crankcase assembly 61 doubles as a transmission case 69, and a transmission gear is housed and disposed inside thereof. In the transmission case 69, a counter shaft 70 (outlined by a dashed line in FIG. 17) is disposed at a predetermined interval rearward in parallel to the crankshaft 65, and further a drive shaft (outlined by a dashed line in FIG. 17) is disposed at a predetermined interval rear downward. Among the above, the counter shaft 70 is supported by the joining surface of the crankcase assembly 61. Further, in the transmission case 69 between the counter shaft 70 and the drive shaft 71, a transmission system (speed change gear) with a predetermined stages is disposed and constituted, and a rotation of the counter shaft 70 is speed-changed and transmitted to the drive shaft 71 via the transmission system. A drive sprocket is attached to a left shaft end part of the drive shaft 71, and via a chain wound between the drive sprocket and a sprocket bridged to an axle of the rear wheel, a motive power is transmitted from the engine unit 60 to the rear wheel.

A clutch device is axially provided in a clutch chamber 72 in a right shaft end part of the counter shaft 70. The clutch device is covered by a clutch cover 67. The clutch device is provided, in its clutch housing, with a plurality of drive plates and driven plates having radiuses in an orthogonal direction to a shaft direction of the counter shaft 70, in a manner to overlap alternately. The clutch device itself is bulky, requiring a substantial disposing space. Further, in this example, it is constituted so that a breather case 73 is adjoined to a left side of the clutch device.

Here, as is known also from FIG. 17, a space is secured in an upper part of the crankcase assembly 61 on a rear side of the cylinder assembly, combined with a fact that the cylinder assembly has the posture inclining forward properly. Further, the transmission case 69 is provided protrudingly rearward from a crankcase assembly 61 main body in a range from a middle of the #2 cylinder or from the #3 cylinder to the #4 cylinder in the vehicle width direction, and thus a space is secured also in a left side region of the transmission case 69 corresponding to almost the #1 cylinder. These spaces are indicated as a space S in FIG. 17.

In the engine unit 60 of the present embodiment, first, the engine itself is surrounded by the vehicle body frame, i.e., by the seat rail 601 with regard to an upper part thereof, the down tube 603 with regard to a front part, and the body tube 604 with regard to a rear part, respectively, as shown in FIG. 14 and so on. An intake system 74 is disposed and constituted in an upper part of the crankcase assembly 61 and on a rear side of the cylinder assembly, as in FIG. 18. The intake system 74 includes, as shown in FIG. 14, FIG. 15 and so on, an intake manifold 76, an injector 77 being a fuel injection device, a throttle body 78, and an intake pipe 70 between the cylinder assembly and an air cleaner 75.

Figure 18:
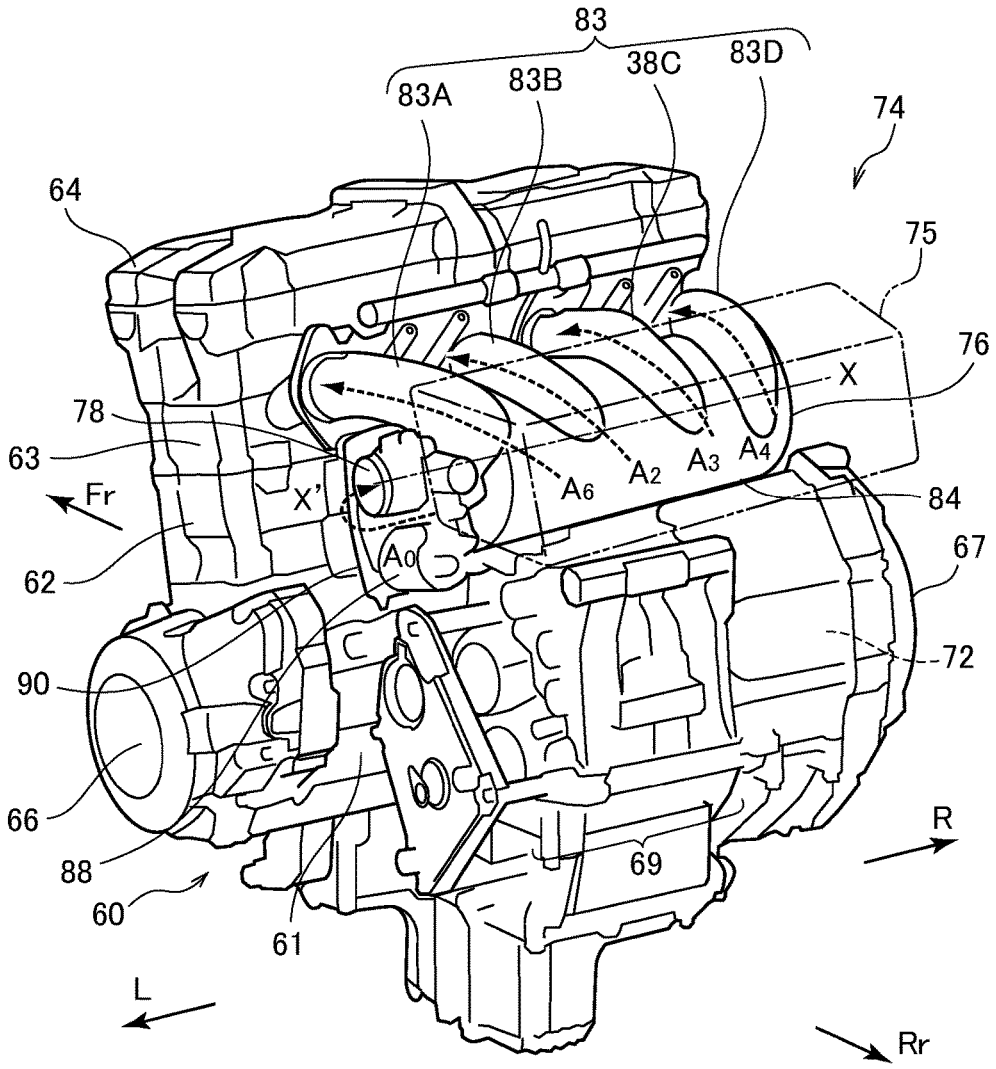
FIG. 18 is a rear perspective view showing the power unit to which the intake system is attached in the second embodiment.

In the present embodiment, in particular the throttle body 78 is disposed as shown in FIG. 18 on an opposite side of the clutch chamber 72 in the vehicle width direction, that is, on a leftward side of the crankcase assembly 61. In other words, the single throttle body 78 is disposed by using the space S corresponding to almost the #1 cylinder.

Figure 19:
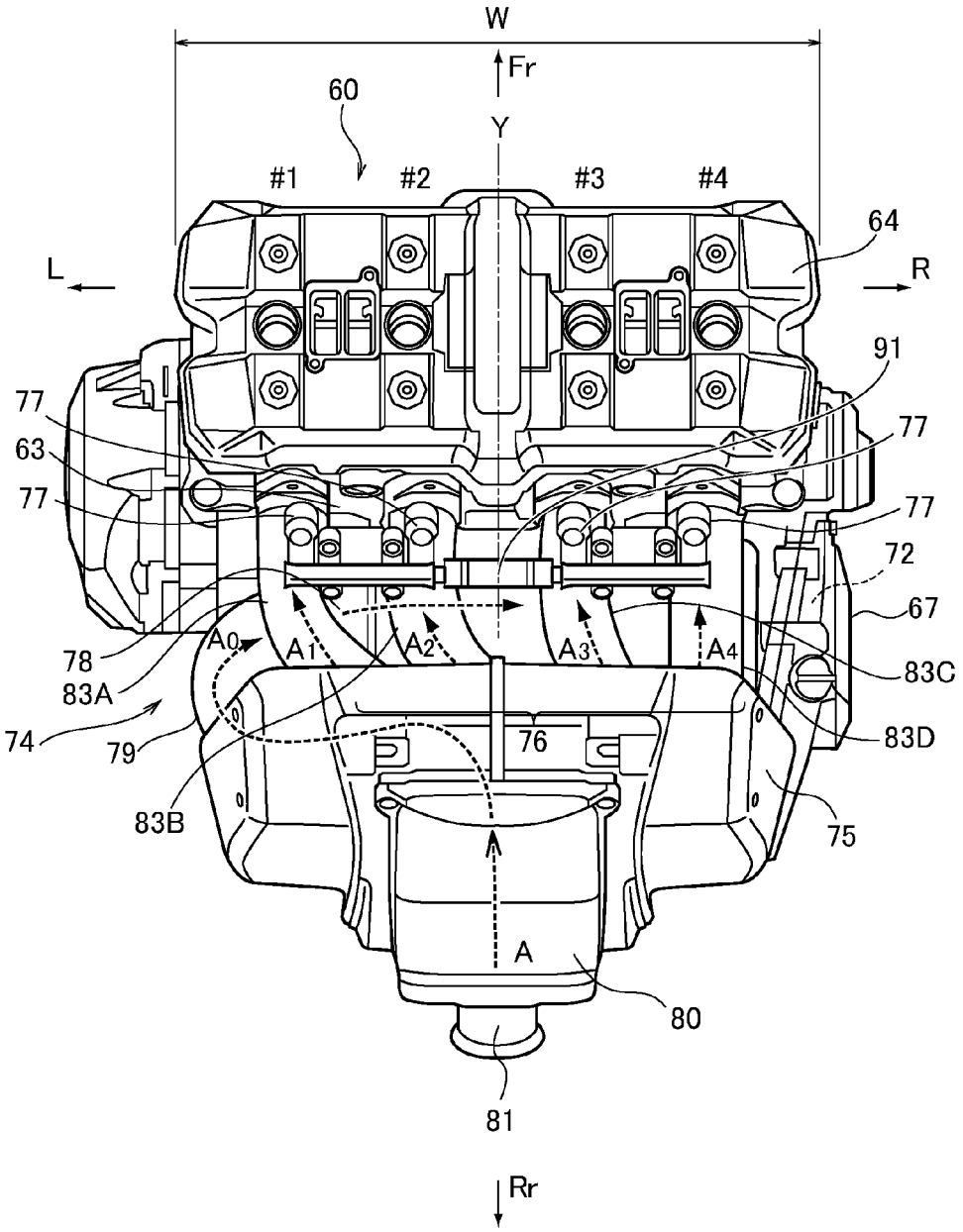
FIG. 19 is a top view showing the power unit to which the intake system is attached in the second embodiment.
Figure 20:
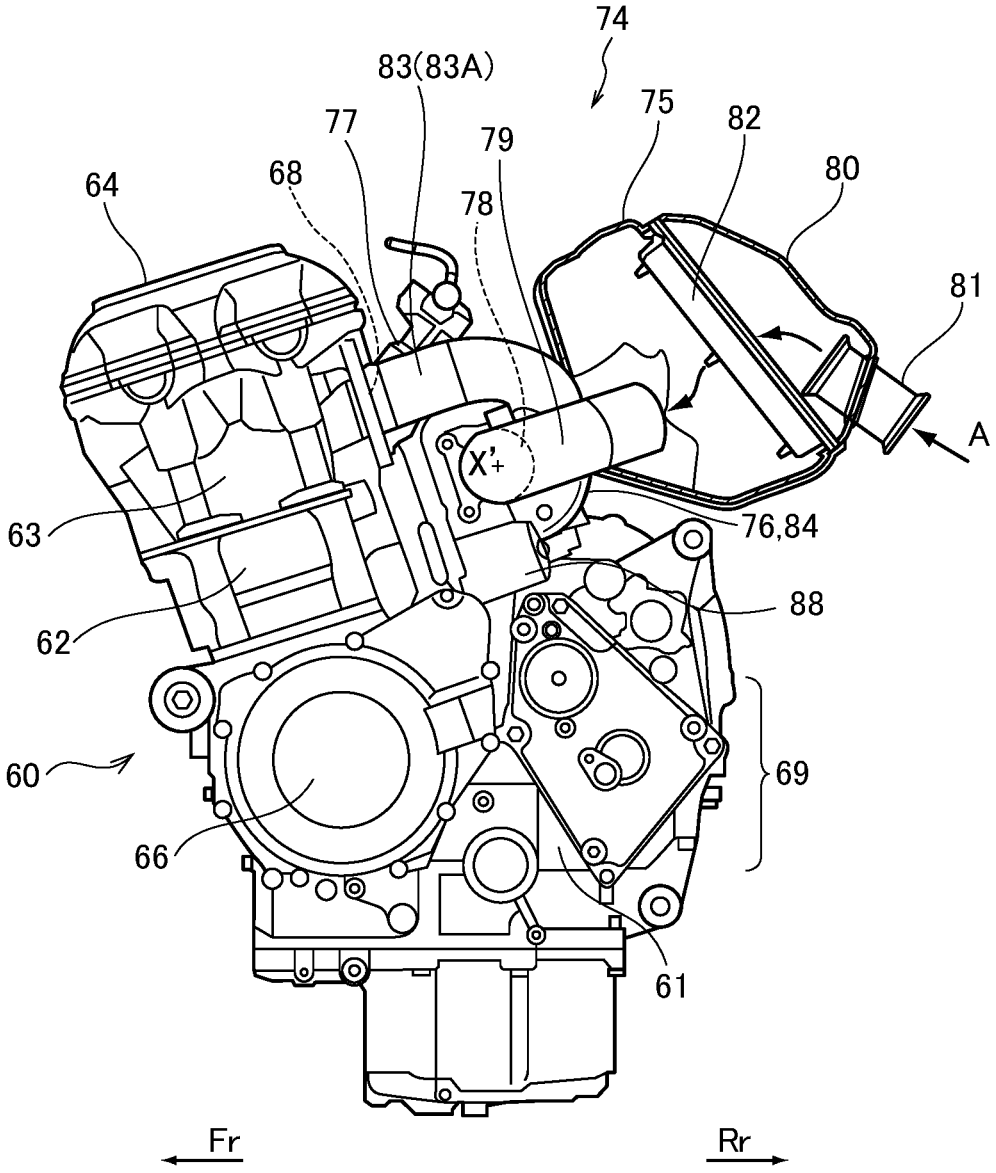
FIG. 20 is a left side view showing the power unit to which the intake system is attached in the second embodiment.

In a concrete constitution of the intake system 74, the air cleaner 75 is disposed in front of the body tube 604 constituting the vehicle body frame, as shown in FIG. 14 and so on. Note that by using the vehicle body frame such as a body frame 604, the air cleaner 75 can be supported at a position of almost the same height as that of the cylinder assembly. The air cleaner 75 is made of a casing extendedly provided horizontally in the vehicle width direction from almost the #1 cylinder to the #4 cylinder as also shown in FIG. 19, and an intake portion 80 for taking in air is attachedly provided to a rear part thereof. The intake portion 80 is equipped with a suction pipe 81 opening rearward, and air A is taken in from the suction pipe 81 as shown in FIG. 20. The suction pipe 81 can be one inclining toward the rear diagonally downward properly as in FIG. 20. A filter element 82 is installed between the air cleaner 75 and the intake portion 80 as in FIG. 20, and air cleaned by the air cleaner 75 led in.

As in FIG. 18, the intake manifold 76 is horizontally placed adjacent to a front side of the air cleaner 75. The intake manifold 76 is, as shown in FIG. 19, extendedly provided horizontally in the vehicle width direction from almost the #2 cylinder to the #4 cylinder. In other words, disposition of the throttle body 78 in the space S corresponding to the #1 cylinder as described above is made possible.

The intake manifold 76 includes a plurality of separated and independent intake tubes 83 (83A, 83B, 83C, 83D) linked to the cylinder heads 63 of the respective #1 to #4 cylinders, and a manifold collecting section 84 which collects those intake tubes integrally and is formed in a shape of a cylinder with a bottom. Note that the manifold collecting section 84 is constituted by a hollow barrel unit having a circular transverse cross section, and has a structure with a bottom where a right end part side is closed in this example. Note that the manifold collecting section 84 can be formed of a synthetic resin or an aluminum die-cast.

Each of intake tubes 83A, 83B, 83C, 83D, the front end part thereof being connected to the intake port 68 (see FIG. 17) as shown in FIG. 20 and so on, is formed in a curved shape to round in an upper part of the throttle body 78 from the front end part thereof toward the rear, as in side view of FIG. 20. The curved shape can typically be a circular arc, and each is smoothly connected to an outer peripheral surface rear side of the manifold collecting section 84 smoothly. A base end side on which the respective intake tubes 83A, 83B, 83C, 83D are connected to the manifold collecting section 84 can be disposed at a practically same pitch interval as an arrangement pitch of the cylinders, that is, an interval in the vehicle width direction of the intake ports 68.

Figure 21:
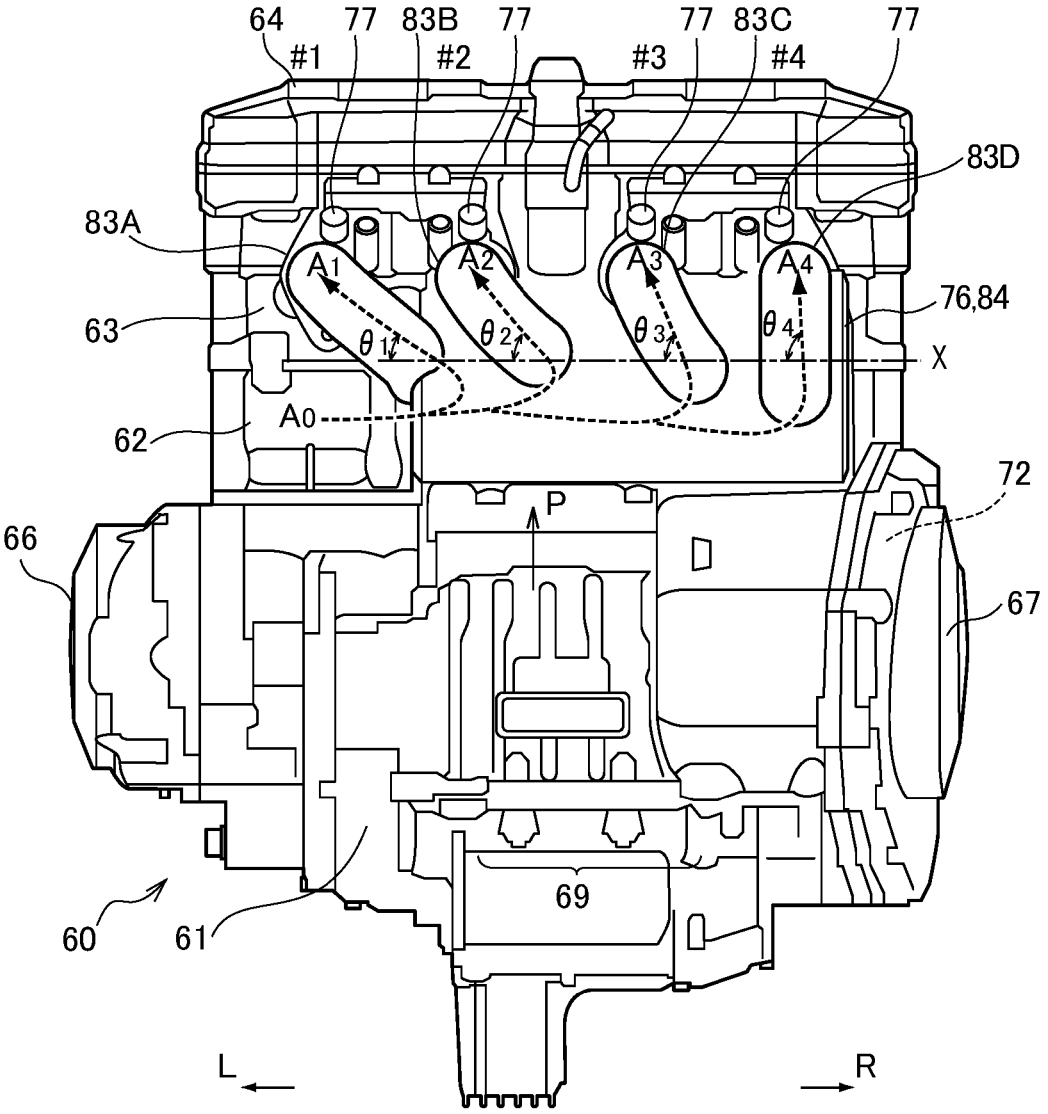
FIG. 21 is a rear view of the power unit, the rear view showing a constitution, an action, and so on of the intake system in the second embodiment.

Further, the intake tube 83 is disposed in a manner that an incline in relation to a longitudinal direction of the manifold collecting section 84 is increased gradually or decreased gradually in rear view. As shown in FIG. 21, with an axis line in the longitudinal direction of the manifold collecting section 84 being an axis line X, an inclination angles $\theta_1$, $\theta_2$, $\theta_3$, $\theta_4$ in relation to the axis line X of the respective intake tubes 83A, 83B, 83C, 83D become gradually larger in sequence as going from the #1 cylinder to the #4 cylinder in this example. Note that the inclination angles $\theta$ of the intake tubes 83A, 83B, 83C, 83D are not limited to a case of the shown example in FIG. 21, but can be changed accordingly in correspondence with a disposition interval of the intake ports 68 or a linear dimension of the manifold collecting section 84.

Here, the intake tube 83A disposed farthest from the clutch chamber 72 among the respective intake tubes 83A, 83B, 83C, 83D is disposed, as in FIG. 19, in a manner to overlap the throttle body 78 in plan view. In other words, the intake tube 83A corresponding to the #1 cylinder where the throttle body 78 is disposed is disposed above the throttle body 78 (see FIG. 20 and so on).

Figure 22B:
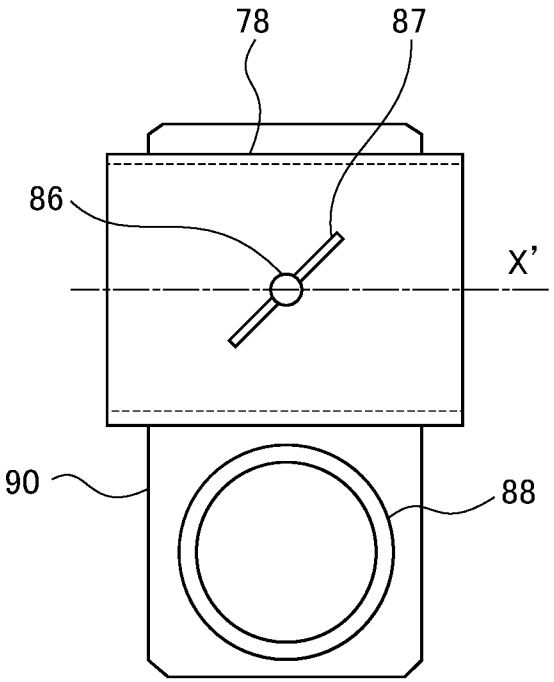
FIG. 22B is a side view showing the constitution example of an electronic throttle according to the second embodiment.
Figure 22A:
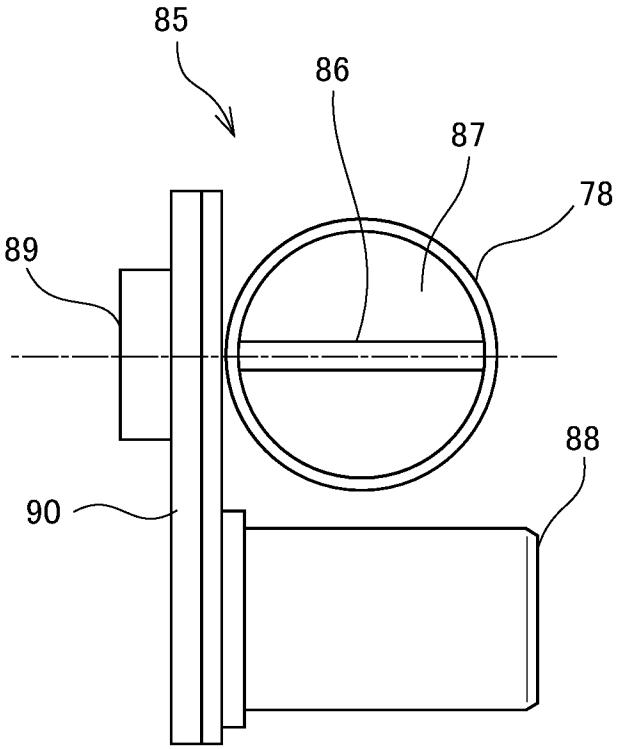
FIG. 22A is a front view showing a constitution example of an electronic throttle according to the second embodiment.

Next, in the present embodiment, what is called an electronic throttle is used. FIG. 22A and FIG. 22B show schematic constitution examples of an electronic throttle 85 according to the present embodiment. The throttle body 78 has a throttle bore inside which intake air flows, and the throttle valve 87 supported pivotally by a predetermined angle via a supporting shaft 86 is installed. The supporting shaft 86 is coupled to be rotation-driven by a drive motor 88, and is constituted so that the drive motor 88 makes the supporting shaft 86 rotate based on a signal from an ECU mounted on the vehicle, thereby to control an opening degree of the throttle valve 87. Note that the opening degree of the throttle valve 87 is detected by a throttle position sensor 89, and its detection signal is feedbacked to an ECU. It is preferable that those components are integrally assembled to a base plate 90 and unitized.

Figure 23:
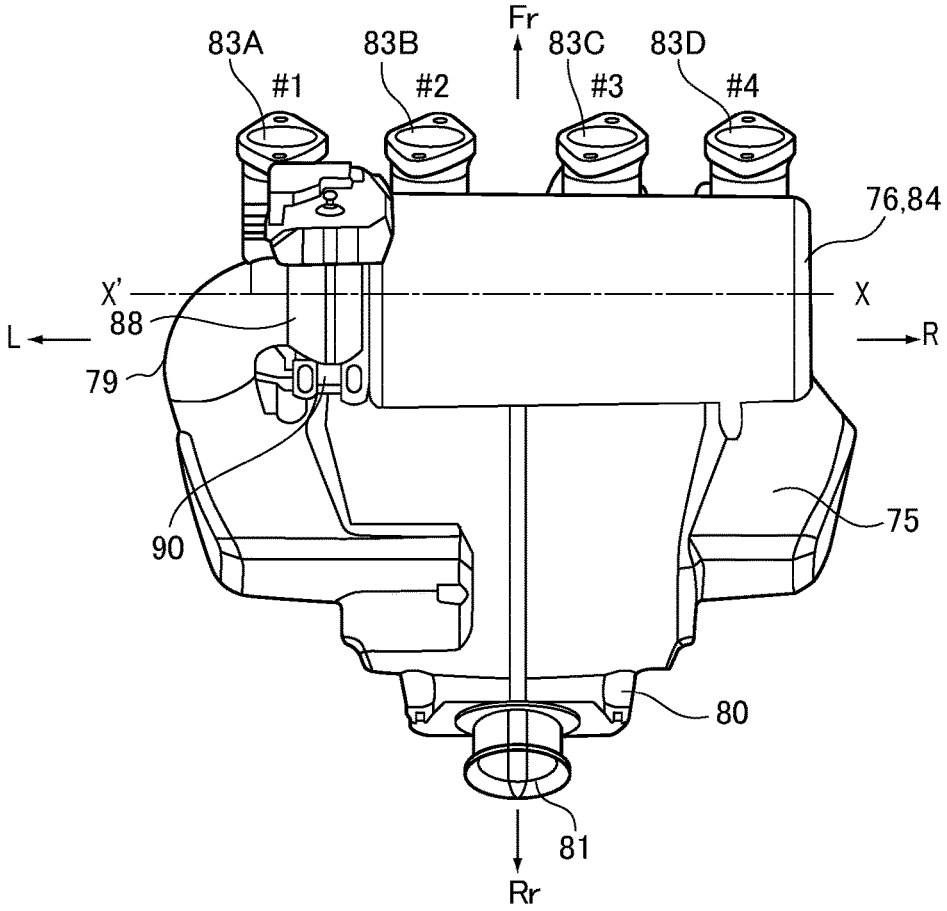
FIG. 23 is a P arrow view of FIG. 21.

In the electronic throttle, a throttle bore center axis X' (FIG. 22A and FIG. 22B) of the throttle body 78 is set to be almost parallel to the vehicle width direction, and the throttle body 78 is integrally fixed to the intake manifold 76. More specifically, as shown in FIG. 18 and so on, the throttle body 78 is fixed to a left end part of the manifold collecting section 84 of the intake manifold 76. The throttle bore of the throttle body 78 is communicated with the inside of the manifold collecting section 84, and in such a case the throttle bore center axis X' can be preferably disposed to be the same as the axis line X of the manifold collecting section 84 (see FIG. 23).

Further, as described above, the throttle body 78 is disposed below the intake tube 83A corresponding to the #1 cylinder. Thus, the throttle body 78 is disposed in an inner side of the cylinder assembly in the vehicle width direction. As shown in FIG. 19, the throttle body 78 is disposed in a range of a width W in the vehicle width direction of the cylinder head cover 64 which is basically the widest among the cylinder assembly.

Here, further, as shown in FIG. 19, in an upper part of each of intake tubes 83A, 83B, 83C, 83D, an injector 77 injecting fuel directing a back of an intake valve disposed in the interior of the intake port 68 is installed directly near the intake port 68 to which each of the intake tubes 83A, 83B, 83C, 83D is connected. Each injector 77 is tube-connected to a main gallery 91, and fuel supplied from a fuel pump to the main gallery 91 is distributed to each injector 77.

With reference to FIG. 14, the injector 77, the intake tube 83 (83A), the throttle valve 87 and its drive motor 88, from above in side view, are disposed tandem almost in parallel to a cylinder axis line Z, below the seat rail 601 in a space surrounded by the cylinder assembly, the air cleaner 75, and the crankcase assembly 61.

Further in a case of above, the air cleaner 75 is disposed in front of the body tube 604, but the intake pipe 79 connecting the throttle body 78 and the air cleaner 75 is not extended to the inside of the air cleaner 75 as shown in FIG. 20. Note that the intake pipe 79 extends from a vicinity of a left end part near a front surface part of the air cleaner 75 toward the front, and is connected to the throttle body 78 while being bent rightward, as shown in FIG. 19, FIG. 20 and so on.

In the intake system 74, in particular, of the engine unit 60 constituted as above, as shown in FIG. 19 and FIG. 20 air A is led in from the suction pipe 81 and thereafter passes through the filter element 82, thereby cleaned air being led in the air cleaner 75. Air in the air cleaner 75 passes through the intake pipe 79 and is supplied to the throttle body 78 (an arrow $A_0$, FIG. 19). Air whose flow amount is controlled by the throttle valve 87 in the manifold collecting section 84 further passes through the intake tubes 83A, 83B, 83*c*, 83D and is supplied respectively to the intake ports 68 of the #1 to #4 cylinders as indicated by arrows $A_1$, $A_2$, $A_3$, $A_4$ of FIG. 19 and so on.

Next, characteristic operation and effect of the present embodiment will be described. First, the throttle body 78 is disposed on an opposite side in the vehicle width direction of the clutch chamber 72.

In a multi-cylinder engine as in the present embodiment, on a rear surface side of the cylinder head 63 a distance between the intake port 68 and an upper surface of the crankcase assembly 61 is largest on the opposite side of the clutch chamber 72. In other words, the clutch chamber 72 has a bulky constitution as described above, and few margin is left in terms of a space above the clutch chamber 72 between the clutch chamber 72 and the intake port 68. As a result that the single throttle body 78 is intensively disposed on a left side in the space S (see FIG. 17) made to offset from such a clutch chamber 72, the space is effectively secured between the cylinder block 62 and the air cleaner 75. As a result of securing of the space, collectivizing of the air cleaner 75 and the intake manifold 76 becomes possible without reducing a capacity. Besides, since the sufficient inertia effect can be obtained in the whole area of the opening degrees of the throttle valve 87 while the sufficient intake tube length being secured, improvement of an output, improvement of a fuel consumption, reduction of a noise, improvement of a cleaning efficiency, and so on can be done.

Further, the throttle bore center axis X' of the throttle body 78 is set to be almost parallel to the vehicle width direction, and the throttle body 78 is integrally fixed to the manifold collecting section 84 of the intake manifold 74.

The throttle body 78 is disposed in a position offset in the vehicle width direction from a vehicle center line Y, on the opposite side of the clutch chamber 72, in the left in this example. Thereby, the throttle bore center axis X' is disposed almost in parallel to the vehicle width direction, and thus a width in a front and rear direction (riding direction) of the intake system as a whole can be effectively curtailed while the sufficient intake tube length and the capacity of the air cleaner 75 are secured. Therefore, it becomes possible to make also a vehicle as a whole compact.

Further, the throttle body 78 is disposed in the inner side of the cylinder assembly in the vehicle width direction, as shown in FIG. 19.

By disposing the throttle body 78 in such a way, a right and left direction width of the intake system as a whole can be made compact while the sufficient intake tube length is secured. The fact that the intake system is made slim and compact prevents a leg of a driver (rider) from touching the intake system in a state of riding, and can improve ridability, riding comfort, or the like. Incidentally, a range in which the driver's leg moves is outer than a dotted line M of FIG. 16, and the intake system is housed compactly in the inner side thereof.

Further, the intake manifold 76 is constituted by including a plurality of intake tubes 83 and the manifold collecting section 84 which integrally assembles those intake tubes.

In other words, the manifold collecting section 84 is disposed in the upper part of the crankcase assembly 61 between the cylinder block 62 and the cylinder head 63 of the engine and the air cleaner 75, and disposed in the same axis direction as the throttle bore center axis X' in a downstream of the throttle body 78, and is disposed in the inner side than a width of the cylinder head 63 in the vehicle width direction. Thereby, the sufficient intake tube length and the sufficient capacity of the air cleaner 75 can be secured.

Further, the respective intake tubes 83A, 83B, 83C, 83D are formed in the curved shape to round in the upper part of the throttle body 78 in side view and is disposed in a manner that inclines in relation to a longitudinal direction of the manifold collecting section 84 increase gradually or decrease gradually in rear view.

As a result that the intake tubes 83A, 83B, 83C, 83D are disposed in such a piping method, the intake tube lengths necessary for obtaining the inertia effect of intake at a target rotation number can be secured in a necessary and sufficient degree, and in addition, the vehicle front and rear width is curtailed to the minimum, so that adjustment of the lengths for maintaining synchronism of the respective cylinders becomes possible, enabling the sufficient inertia effect in the whole area of the throttle valve opening degrees.

In this example, as shown in FIG. 21, the inclination angles $\theta_1$, $\theta_2$, $\theta_3$, $\theta_4$ of the intake tubes 83A, 83B, 83C, 83D are made smaller as going near to the throttle body 78, and thereby the length of the intake tubes 83*a*, 83B, 83C, 83D themselves become longer as going toward the #1 cylinder. By inclinedly disposing the intake pipes 83A, 83B, 83C, 83D, the intake tube lengths are secured while the throttle body 78 is placed in a vehicle width direction center of the engine, so that an entire width of the intake pipes 83A, 83B, 83C, 83D can be made compact. Then, in the intake manifold 76 as a whole, flow path lengths of the intake of the intake pipes 83A, 83B, 83C, 83D can be practically the same length, and it becomes possible to balance the #1 to "4 cylinders with one another.

Further, the intake tube 83A disposed farthest from the clutch chamber 72 overlaps the throttle body 78 in plan view.

In other words, by disposing the intake tube 83A above the throttle body 78, it is possible to make the width of the intake system as a whole compact while making the intake tube length sufficient.

Further, in the space surrounded by the vehicle body frame, the crankcase assembly 61, and so on, the injector 77, the intake pipes 83, the throttle valve 87, and its drive motor 88 are disposed tandem almost in parallel to the cylinder axis line Z from above in side view, as shown in FIG. 14.

As a result that the respective functional components are disposed tandem in stages as above, the intake system as a whole can be laid out compactly. In other words, as a method for securing a sufficient intake tube length and necessary air cleaner volume to curtail a front and rear width of an intake system as a whole, quite an effective disposition method in which functional components are disposed tandem almost in parallel to a cylinder axis line Z is realized.

Further, the intake pipe 79 connecting the air cleaner 75 and the throttle body 78 is connected in a manner not to be extended to the inside of the air cleaner 75.

By connecting the intake pipe 79 to the air cleaner 75 as above, the air cleaner capacity is not reduced, and consequently the engine output is improved.

Hereinabove, the embodiments and examples of the present invention are described in detail with reference to the drawings, but the above embodiments and examples merely illustrate concrete examples of implementing the present invention. The technical scope of the present invention is not to be construed in a restrictive manner by these embodiments. The present invention may be amended in various forms without departing from the technical spirit thereof, and such amendments are included in the technical scope of the present invention.

For example, in the above embodiment, the constitution in which the intake system of the internal combustion engine according to the present invention is applied to an on-road-type motorcycle is shown, but types of motorcycles to which the present invention is applied is not limited. The above motorcycle is merely an example of the motorcycle to which the present invention can be applied. The present invention can be applied to any type of motorcycle as long as the motorcycle has a side cam chain type parallel multi-cylinder engine. Further, the number of the cylinders shown in the present embodiment is an example, and the present invention can be applied regardless of the number of cylinders.

Further, though the example in which the manifold collecting section 84 has the circular transverse cross-sectional shape is described, it is possible to make a transverse cross-sectional shape be an oval shape or the like, in correspondence with a special relationship with neighboring components or members.

Further, if a clutch is disposed on a left side of the engine, contrary to the above embodiment, a throttle body is disposed on the opposite side, i.e., on the right side.

The present invention is also effectively applicable to a case where the number of cylinders in an engine unit is equal to or less than three or equal to or more than four.

According to the present invention, a collective single electronic control type throttle body is disposed in an extra space on an opposite side of a clutch chamber behind a cylinder assembly. By such a disposition constitution, intake manifolds are gathered, which has been impossible in a conventional motorcycle, and an intake amount is controlled by one throttle body. Thereby, securing of a sufficient length of an intake tube and an intake system capable of securing an air cleaner capacity as much as or more than conventionally can be realized.

Further, according to the present invention, one throttle body is disposed in a position biased to an arrangement direction of cylinders. Thus, the space is formed behind a cylinder head. The intake manifolds are gathered in this space and the intake amount is controlled by one collective throttle body. Thereby, the length of the intake tube can be made longer without enlarging the space necessary for disposition of the intake system.

The present invention is a technology effective to an engine unit of a motorcycle. According to the present invention, it is possible to realize an intake system enabling securing a sufficient intake tube length and securing an air cleaner capacity as much as or more than conventionally. Further, according to the present invention, the length of the intake tube can be made longer without making a space necessary for disposition of the intake system larger.

What is claimed is:

1. An engine unit of a motorcycle in which a plurality of cylinders are disposed in parallel in a vehicle width direction and a clutch chamber is disposed in either one of the right and the left in the vehicle width direction, the engine unit comprising:

an intake manifold, a fuel injection device, a throttle body, and an intake pipe disposed between a cylinder assembly and an air cleaner in an upper part of a crankcase assembly, wherein said throttle body is disposed on an opposite side in the vehicle width direction of the clutch chamber.

2. The engine unit of the motorcycle according to claim 1, wherein a throttle bore center axis of said throttle body is set to be almost parallel to the vehicle width direction and said throttle body is integrally fixed to said intake manifold.

3. The engine unit of the motorcycle according to claim 1, wherein said throttle body is disposed on an inner side in the vehicle width direction of said cylinder assembly.

4. The engine unit of the motorcycle according to claim 1, wherein said intake manifold includes a plurality of separated intake tubes connected to cylinder heads of respective cylinders and a manifold collecting section formed in a cylinder shape having a bottom, the manifold collecting section gathering the intake tubes integrally.

5. The engine unit of the motorcycle according to claim 4, wherein the respective intake tubes are formed in curved shapes to round rearward in an upper part of said throttle body in side view and are disposed in a manner that inclines in relation to a longitudinal direction of said manifold collecting section are increased gradually or decreased gradually in rear view.

6. The engine unit of the motorcycle according to claim 4, wherein the intake tube disposed farthest from the clutch chamber overlaps said throttle body in plan view.

7. The engine unit of the motorcycle according to claim 4, wherein an engine is surrounded by a vehicle frame, that is, a seat rail with regard to an upper part thereof, a down tube with regard to a front part, and a body tube with regard to a rear part, respectively, and wherein, said fuel injection device, the intake tubes, a throttle valve, and its drive motor, from above in side view, are disposed tandem almost in parallel to a cylinder axis line in a space surrounded by the cylinder assembly, the air cleaner, and the crankcase assembly below the seat rail.

8. The engine unit of the motorcycle according to claim 1, wherein the air cleaner is disposed in front of the body tube constituting the vehicle frame, and said intake pipe connecting said throttle body and the air cleaner is connected without being extended to the inside of the air cleaner.

* * * * *